United States Patent [19]

Kato et al.

[11] Patent Number: 4,586,417

[45] Date of Patent: May 6, 1986

[54] ELECTRONIC MUSICAL INSTRUMENTS PROVIDED WITH REVERBERATION TONE GENERATING APPARATUS

[75] Inventors: Mitsumi Kato; Tsuyoshi Futamase, both of Hamamatsu, Japan

[73] Assignee: Nippon Gakki Seizo Kabushiki Kaisha, Hamamatsu, Japan

[21] Appl. No.: 658,139

[22] Filed: Oct. 5, 1984

Related U.S. Application Data

[63] Continuation of Ser. No. 400,144, Jul. 20, 1982, abandoned.

[30] Foreign Application Priority Data

Jul. 28, 1981 [JP] Japan ..... 56-118112
Aug. 31, 1981 [JP] Japan ..... 56-137298
Sep. 2, 1981 [JP] Japan ..... 56-138035

[51] Int. Cl.[4] ..... G10H 1/02; G10H 1/18; G10H 7/00

[52] U.S. Cl. ..... 84/1.17; 84/1.19; 84/1.24; 84/DIG. 26; 381/63

[58] Field of Search ..... 84/1.17, 1.19, 1.24, 84/DIG. 26; 381/63

[56] References Cited

U.S. PATENT DOCUMENTS

| | | | |
|---|---|---|---|
| 3,816,637 | 6/1974 | Whitefield | 84/1.24 |
| 4,005,268 | 1/1977 | Canell et al. | 381/63 |
| 4,093,820 | 6/1978 | Yamashita et al. | 381/63 |
| 4,105,864 | 8/1978 | Berkovitz | 381/63 X |
| 4,215,242 | 7/1980 | Gross | 381/63 |
| 4,237,343 | 12/1980 | Kurtin et al. | 381/63 |
| 4,275,267 | 6/1981 | Kurtin et al. | 84/DIG. 26 |
| 4,350,072 | 9/1982 | Deutsch | 84/1.24 |
| 4,358,980 | 11/1982 | Imamura | 84/1.19 |
| 4,391,176 | 7/1983 | Niinomi et al. | 84/1.19 |
| 4,392,405 | 7/1983 | Franz et al. | 84/1.24 |

*Primary Examiner*—Stanley J. Witkowski
*Attorney, Agent, or Firm*—Blakely, Sokoloff, Taylor & Zafman

[57] ABSTRACT

In an electronic musical instrument, a reverberation tone most suitable for a selected tone color is applied to a musical tone with the selected tone color. In a modification, the electronic musical instrument is provided with a plurality of keyboards and to musical tones to be produced corresponding to the keyboards reverberation tones are applied independently. In another modification, one of the reverberation tones has a reverberation characteristic different from the other reverberation tone.

9 Claims, 36 Drawing Figures

ELECTRONIC MUSICAL INSTRUMENTS PROVIDED WITH REVERBERATION TONE GENERATING APPARATUS

This is a continuation of application Ser. No. 400,144, filed July 20, 1982, and now abandoned.

BACKGROUND OF THE INVENTION

This invention relates to an electronic musical instrument provided with reverberation tone generating apparatus.

In the prior art electronic musical instrument provided with reverberation tone generating apparatus, the reverberation are formed by utilizing mechanical vibration of a spring or such analog delay element as a BBD (bucket brigade device) and a CCD (charge coupled device).

The reverberation characteristics of an optimum reverberation to be added to a performed musical tone are to be changed depending upon a selected tone color, so that in order to add a reverberation most suitable for the tone color of a performed musical tone, it is necessary to set such characteristics as the length and depth of the reverberation according to the selected tone color but such expedient is troublesome.

Furthermore, in an electronic musical instrument having a plurality of keyboards, for example a upper keyboard, a lower keyboard, a pedal keyboard and a solo keyboard for producing musical tones having different tone colors, it is also desirable to add reverberation tones to the musical tones produced by respective keyboards. In such a case, depending upon the mode of selection of the tone colors of respective keyboards, there occurs a case wherein a tone color suitable to be added with a reverberation tone and a tone color not suitable to be added with a reverberation tone are simultaneously selected. For example, where the tone color of a vibraphone is selected by a upper keyboard or a solo keyboard and the tone color of an organ is selected by a lower keyboard, since the amplitude envelope of the tone color of the vibraphone is long and more over since it is amplitude modulated it is not necessary to add a reverberation. However, when added with a long and deep reverberation like a performed musical tone in a church, the musical tone of the organ manifests an excellent effect. There are many cases in which a performed musical tone of a keyboard having a given tone color is produced as it is without adding thereto any reverberation tones for the purpose of producing an effect of emphasizing the given tone color.

In an electronic musical instrument having a plurality of keyboards, where it is desired to add reverberations to musical tones performed by some of the keyboards, it is desirable to construct the circuit such that a keyboard, the musical tone produced thereby being required to be added with a reverberation tone can be selected freely depending upon the selected tone color or conditions of performance of the keyboard.

Where reverberation tones are to be added to musical tone signals produced by a musical tone signal generating circuit of an electronic musical instrument provided with a plurality of keyboards, for example, an upper keyboard, a lower keyboard, a pedal keyboard and a solo keyboard, since the musical tone elements, the tone color for example, are different for different keyboards, it is desirable to make different such characteristics as the length and depth of the reverberations depending upon respective musical tone elements for the purpose of improving the performance effects. Accordingly, it is desired to make different the reverberation characteristics for different keyboards.

SUMMARY OF THE INVENTION

Accordingly, it is the principal object of this invention to provide an electronic musical instrument capable of adding to the performed musical tone a reverberation tone having a high quality and characteristic most suitable for the tone color of the performed musical tone.

Another object of this invention is to provide an electronic musical instrument provided with a plurality of keyboards and can freely select a performed musical tone to be added with a reverberation for respective keyboards.

Still another object of this invention is to provide an electronic musical instrument provided with a plurality of keyboards in which reverberation tone having desired reverberation characteristics can be added to musical tones produced by respective keyboards or to musical tone signals produced by a plurality of musical tone signal generating circuits.

According to this invention, there is provided an electronic musical instrument comprising keyboard means having a plurality of keys,tone color selecting means for selecting a tone color among different tone colors and for outputting tone color information representing the selected tone color, tone generating means for generating a musical tone signal having a pitch corresponding to a depressed key among the keys and the selected tone color in response to the tone color information, and reverberation tone generating means for adding a reverberation tone signal having a reverberation characteristic corresponding to the selected tone color to the musical tone signal.

In a modified embodiment, the electronic musical instrument is provided with a plurality of keyboards, the musical tone signal generating circuit produces digital musical tone signals corresponding to depressed keys of respective keyboards and wherein there is provided selecting means for selecting a digital musical tone signal of a desired keyboard among the digital musical tone signals and for supplying the selected digital musical tone signal to the reverberation tone generating apparatus.

In another modification, the electronic musical instrument is provided with a plurality of musical tone signal generating apparatus for producing digital musical tone signals corresponding to depressed keys of respective keyboards, and a plurality of digital type reverberation tone generating apparatus for adding to the digital musical tone signals reverberations having different characteristics.

BRIEF DESCRIPTION OF THE DRAWINGS

In the accompanying drawings:

FIGS. 2*a* through 6*a* show basic circuit constructions of different reverberation tone generating apparatus suitable for various tone colors;

FIGS. 2*b* through 6*b* show the reverberation characteristics of the reverberation tone generating apparatus shown in FIGS. 2*a* through 6*a;*

DESCRIPTION OF THE PREFERRED EMBODIMENTS

Figure 1:
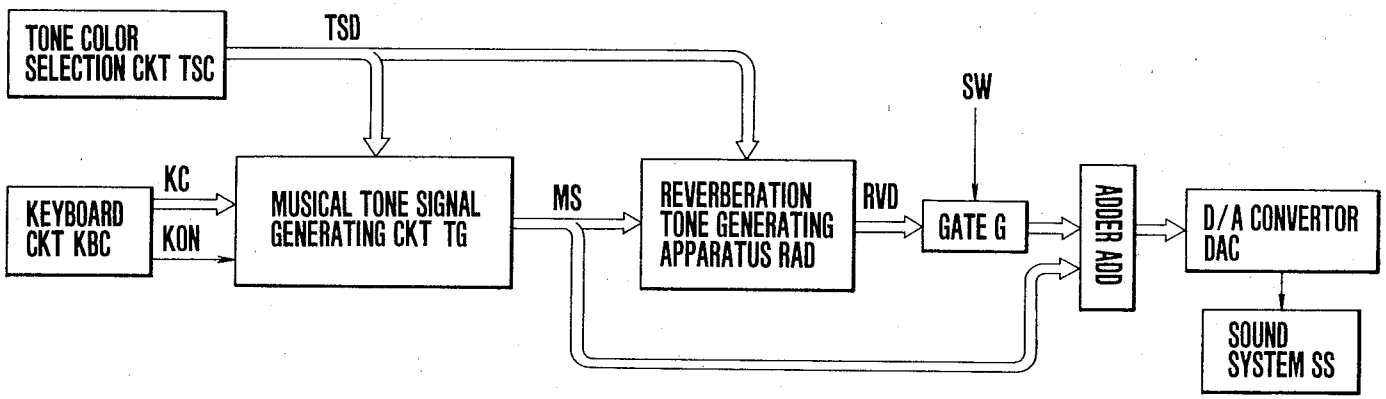
FIG. 1 is a general block diagram showing one embodiment of the electronic musical instrument according to this invention.

Referring now to FIG. 1, a preferred embodiment of the electronic musical instrument of this invention comprises a tone color selection circuit TSC, a keyboard circuit KBC, a musical tone signal generating circuit TG, a reverberation tone generating apparatus RAD, a gate circuit G, an adder ADD, a digital/analog converter DAC, and a sound system SS which are connected as shown.

The tone color selection circuit TSC is provided with a tone color selecting member, not shown, which selects and sets the tone color of a musical tone to be produced by such musical instruments as a flute, an organ or the like. When the tone color selecting member of a flute, for example is operated, a selected tone color information TSD showing that the tone color of a flute has been selected is produced. The selected tone color information TSD is supplied to the musical tone signal generating circuit TG and to the reverberation adding apparatus RAD.

The keyboard circuit KBC is provided with a plurality of key switches, not shown, which are operated when associated keys of a keyboard are depressed. An operated key switch produces a key code KC showing the note pitch of a depressed key and a key-on signal KON showing that which one of the keys has been depressed.

Based on the key code KC outputted from the keyboard circuit KBC and the selected from the keyboard circuit KBC and the selected tone color information TSD outputted from the color selection circuit TSC, the musical tone signal generating circuit TC formes a musical tone signal corresponding to the note pitch of a depressed key and outputs the musical tone signal under the control of tone production timing of the key-on signal KON. The musical tone signal generating circuit TG is of the harmonic synthesizing type, frequency (amplitude) modulating type or waveform memory read out type and produces a digital musical tone signal in this example.

Based on the selected tone color information TSD and the musical tone signal MS, the reverberation tone generating apparatus RAD forms a reverberation signal RVD for the musical tone signal corresponding to the selected tone color. The detail of the construction of the reverberation adding apparatus RAD will be described later with reference to FIG. 7 but by changing the content of the control program according to the selected tone color information TSD, the relation among delay circuits DC1, DC2 and DC3, lowpass filters LPF, highpass filters BPF and bandpass filters BPF connected to the inputs of these delay circuits can be changed as shown in FIGS. 2*a* through 6*a* so as to produce different reverberation characteristics as shown in FIGS. 2*b* through 6*b*. The constructions shown in FIGS. 2*a* through 6*a* and the characteristics shown in FIGS. 2*b* through 6*b* respectively correspond to the tone colors of a flute, a string ensemble, an organ, a saxophone, a vibraphone, and a trumpet as shown in the following Table I.

TABLE I

Figure 2B:
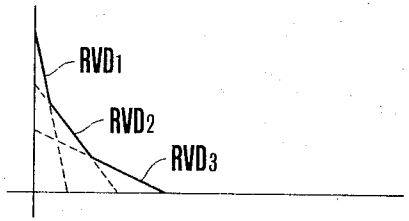
Figure 3B:
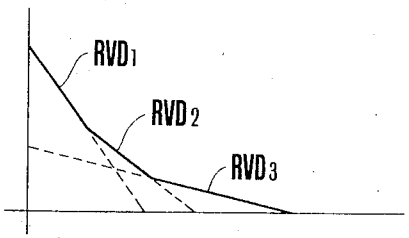
Figure 2A:
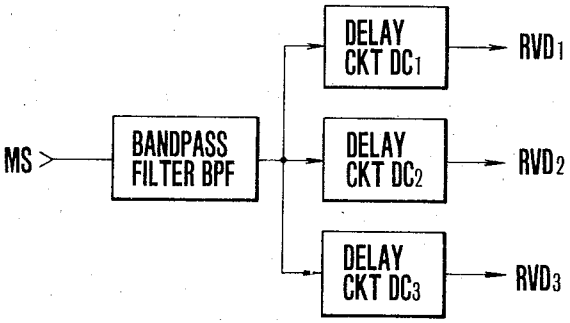
Figure 3A:
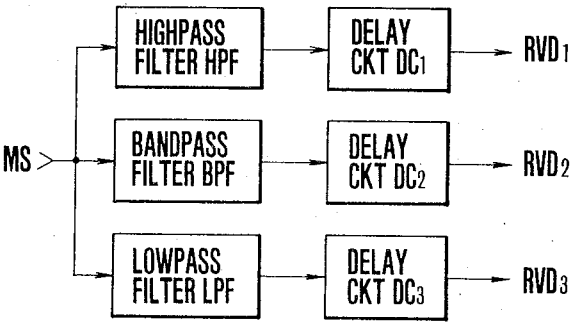
Figure 4B:
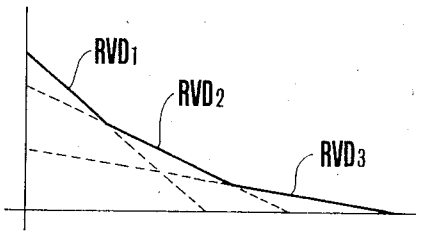
Figure 5B:
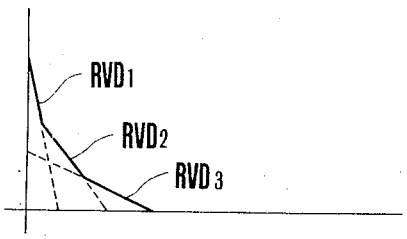
Figure 4A:
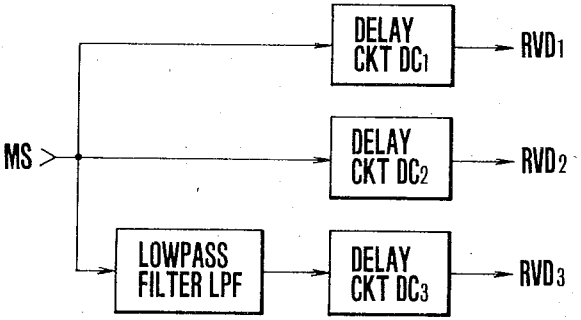
Figure 5A:
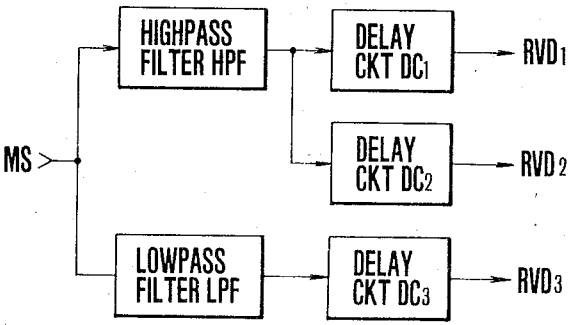
Figure 6B:
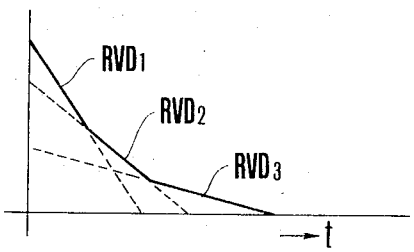
Figure 6A:
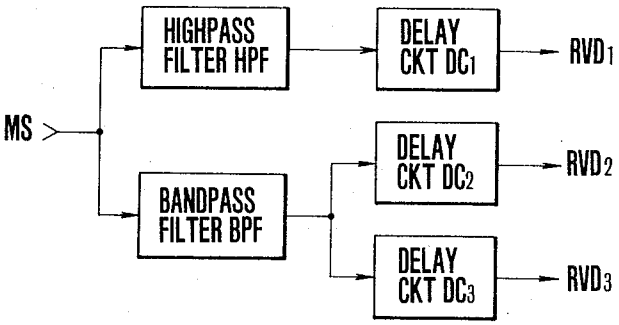

| tone color | construction | characteristic | length of reverberation | depth of reverberation |
|---|---|---|---|---|
| flute | FIG. 2a | FIG. 2b | short about 1 ms | medium |
| string ensemble | FIG. 3a | FIG. 3b | medium (about 2 ms) | slightly deep |
| organ | FIG. 4a | FIG. 4b | long (about 3 ms) | deep |
| saxophone | FIG. 5a | FIG. 5b | short | shallow |
| vibraphone | FIG. 2a | FIG. 2b | short | shallow |
| trumpet | FIG. 6a | FIG. 6b | medium | medium |

The reverberation signal RVD produced by the reverberation tone generating apparatus RAD is supplied to the adder on ADD via the gate circuit G to be added to the musical tone signal MS outputted from the musical tone signal generating circuit TG. The output of the adder ADD is converted into an analog signal by the digital/analog converter DAC and then produced as a musical tone by the sound system SS. As above described, a reverberation tone corresponding to a selected tone can be added. The gate circuit G is constructed to supply the reverberation signal to the adder ADD only when it is supplied with a signal SW showing that a reverberation is to be added to a performed musical tone.

Figure 8:
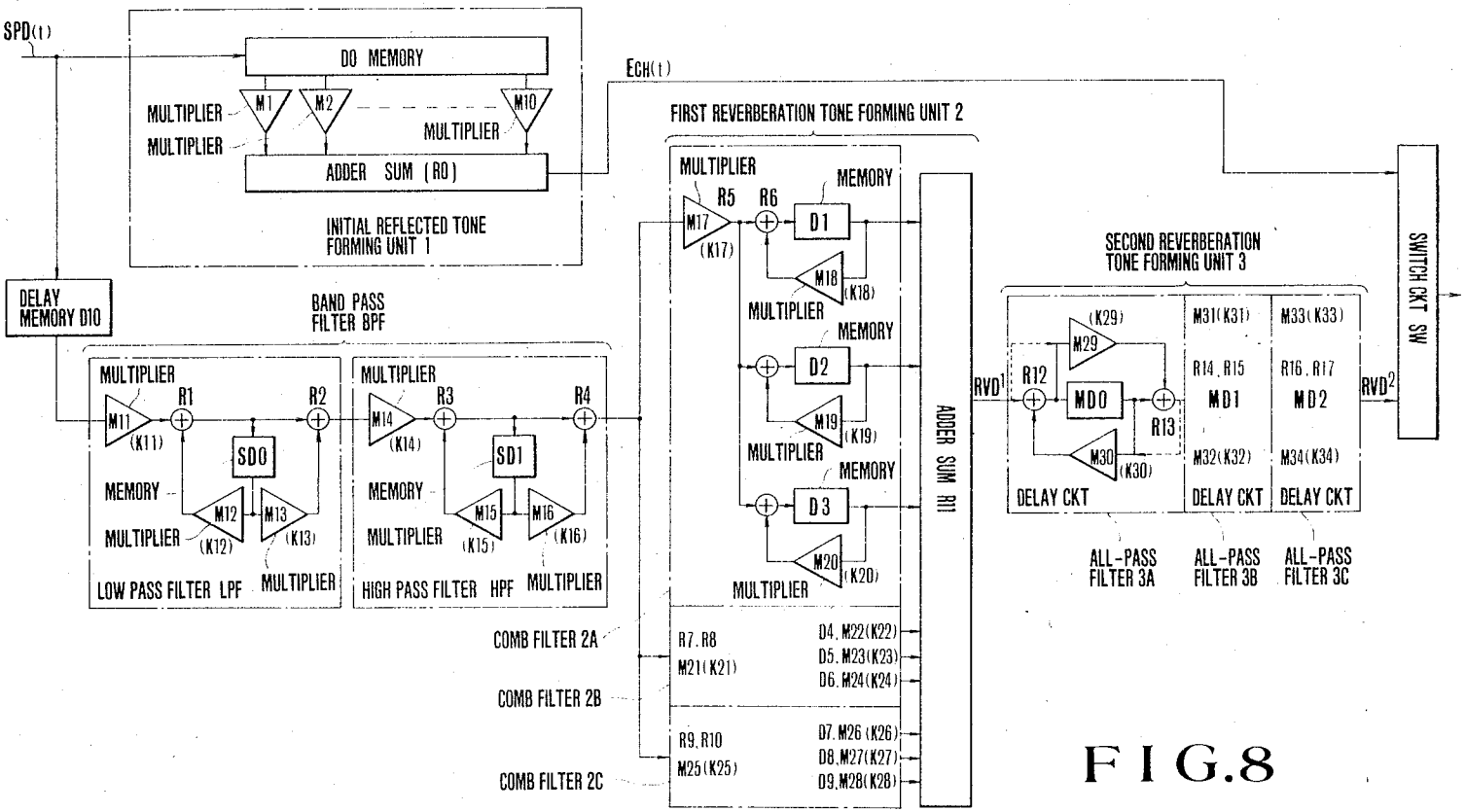
FIG. 8 is a functional block diagram for explaining the operation of the apparatus shown in FIG. 7.
Figure 9:
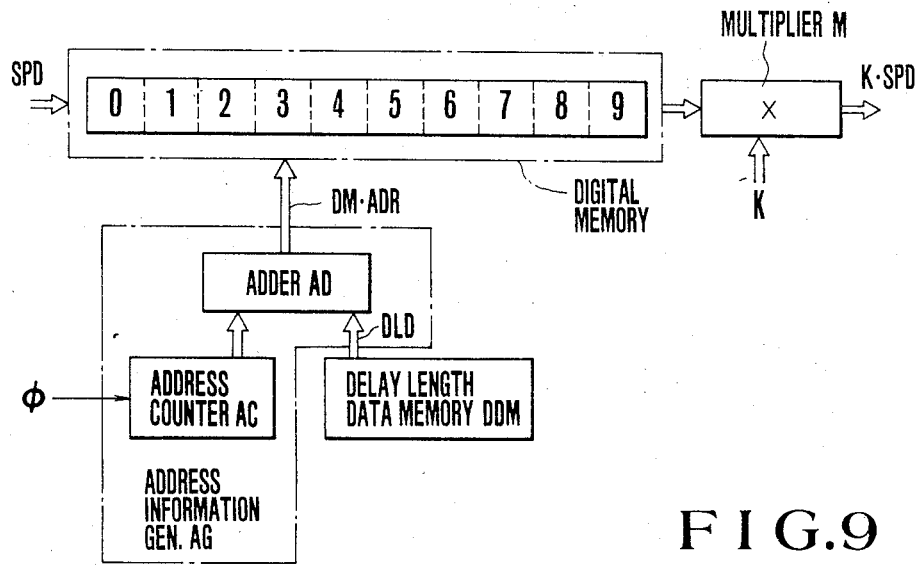
FIGS. 9 and 10 are block diagrams showing the basic constructions of delay circuits.

For the sake of description, the basic construction and operation of the delay circuits shown in FIGS. 9 an 10 will be firstly described. Then the process of forming a reverberation tone will be described with reference to the performance block diagram shown in FIG. 8 and finally a preferred example of the reverberation adding apparatus shown in FIG. 7 will be described in detail.

Basic construction of a delay circuit utilizing a digital memory device

Where amplitude data SPD(t) of an input musical tone signal sequentially sampled at a predetermined sampling period $T_o$ are to be sequentially stored in a digital memory device and an amplitude data SPD (t−i) stored at a time (t−i) is to be read out at a time later by an interval i, an address interval ΔADR representing a change during the inteval i is added to or subtracted from an address information ADR(t) at a sampling time t according to the following equation (1) or (2) to determine an address information ADR(t−i) at time (t−i), and then the address information ADR(t−i) is applied to the address input of the digital memory device.

$$ADR(t-i)=ADR(t)+\Delta ADR \quad (1)$$

$$ADR(t-i)=ADR(t)-\Delta ADR \quad (2)$$

Thus, the amplitude data SPD(t−i) stored at time (t−i) can be read out at a time later by i expressed by $$=\Delta ADR\times T_o \quad (3)$$

In other words, where an address interval ADR corresponding to the desired delay time i is applied as a delay time information it is possible to read out the amplitude data SPD(t−i) stored at the time (t−i) at a time later by the interval i. The equation (1) that determines the address information ADR(t−i) at time (t−i) is applicable to a case where the amplitude data SPD(t) is sequentially stored from a higher order address toward the lower order address the time elapses. The equation (2) is applicable where the amplitude data SPD(t) is sequentially stored from the lower order address toward the higher order address.

Accordingly, the delay circuit according to this invention comprises, as the fundamental elements, a digital memory device DM sequentially storing the amplitude data SPD(t), an address information generator AG that forms the read address information shown in equation (1) or (2), and a delay length data memory device DDM which generates the address interval ADR as a delay time information DLD.

FIG. 9 shows one example of the delay circuit based on this concept and constituted by the digital memory device DM, the address information generator AG, a delay length data memory device DDM and a multiplier M.

Figure 11:
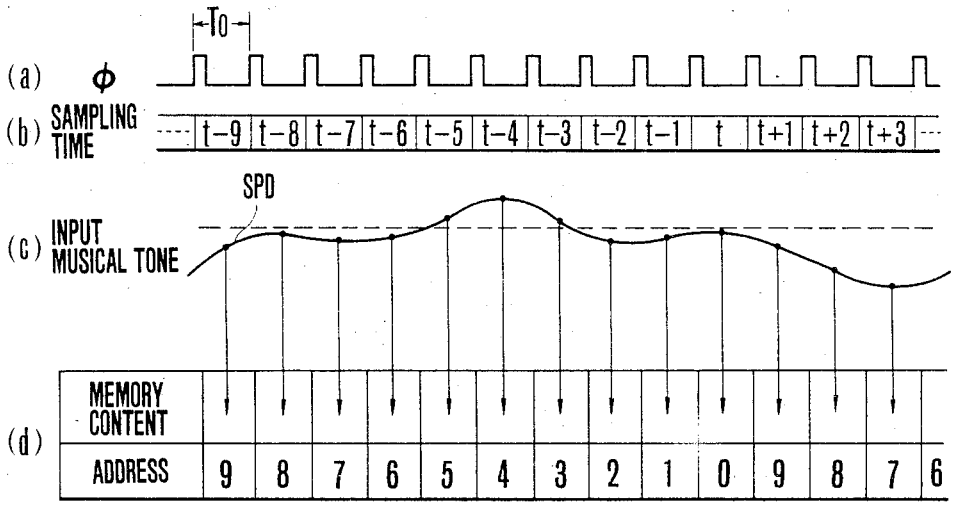
FIG. 11 is a timing chart useful to explain the operation of the delay circuit shown in FIG. 9.

As shown by the timing chart shown in FIG. 11, the digital memory device DM sequentially stores in its memory areas of addresses 0 through 9 the amplitude data SPD(t) sampled at a predetermined period $T_o$ according to a clock pulse $\phi$ starting from the higher order address 9 toward the lower order address, and is constituted by a random access memory device (RAM) or a shift register.

The designation of the write and read addresses of the amplitude data SPD(t) in the digital memory device DM is effected by the address information generator AG which comprises an address counter AC and an adder AD and forms write address informations ADR(t), ADR(t+1), ADR (t+2), . . . ADR(t+i) whose values are renewed with the sampling time and an read address information ADR(t−i) shown by equation (1) and these write and read address informations are outputted as an address information DM ADR for the digital memory device DM. More particularly the address counter AC counts the number of clock pulses having the period $T_o$ to output its count as the write address information ADR(t) of the amplitude data SPD(t) at the present sampling time, and the information ADR(t) is applied to one input of the adder AD. The delay length data memory device DDM supplies a time information DLD ($\Delta ADR=i/T_o$) corresponding to a desired delay time i to the other input of the adder AD. Then the adder performs an arithmetic operation represented by equation (1) at a given sampling time to output the result of addition as a read address information ADR(t−i) of the amplitude data SPD(t−i) before interval i, and then outputs the output information ADR(t) of the address counter AC as the write address information ADR(t) of the amplitude data SPD (t) at the present time, as it is.

In this manner, at time t, the amplitude data SPD(t−i) which was stored at time (t−i) before an interval i is read out from the digital memory device DM, while the amplitude data SPD(t) at the present time t is stored in the area of the address designated by the address information ADR (t).

The amplitude data SPD(t−i) thus read out from the digital memory device DM later by the interval i is multiplied with a coefficient K for controlling the amplitude level in the multiplier M so that the level of the amplitude data is controlled, and the level controlled amplitude data K·SPD(t−i) is converted into an analog signal by a digital to analog (D/A) converter not shown. Such operation is performed at each sampling time. As a consequence, a reverberation tone i time later than the input musical tone can be produced. In this case, when a plurality of delay time informations DLD which are different from each other at a sampling time are given sequentially, on the time division basis, a plurality of informations regarding reverberation tones having different delay times at the same sampling time can be produced. Accordingly, in this embodiment, the delay circuit shown in FIG. 9 is utilized to form initial reflected tones having complicated reverberation characteristics whose amplitude level and delay time differ depending upon the difference in the distances to the reflecting members such as surrounding walls.

Figure 10:
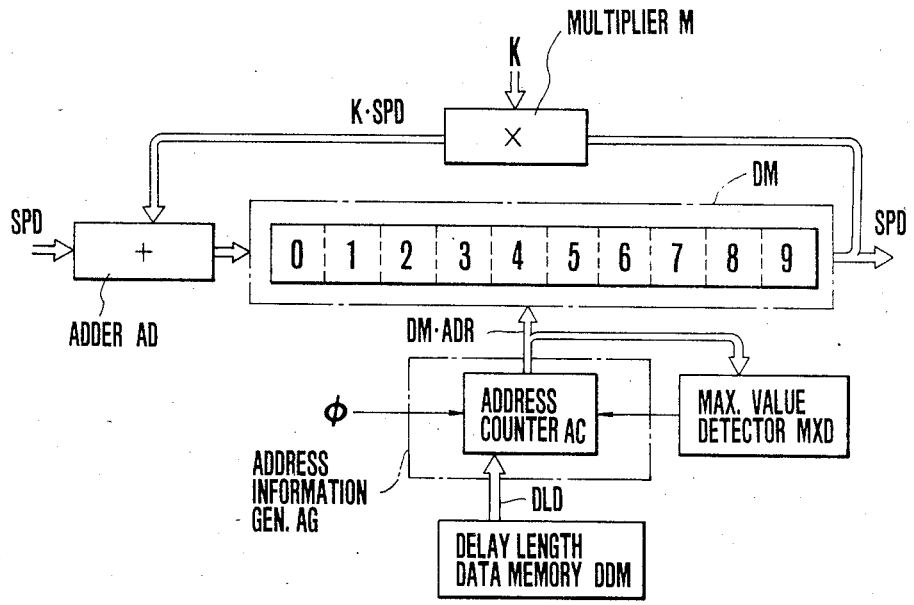

FIG. 10 shows another example of the delay circuit, in which the address counter AC of the address information generator AG is constituted by a preset type down counter. Thus, a delay time information DLD corresponding to a desired delay time i is preset in the address counter AC and the preset value is counted down so as to match the repetition period of the address informtions ADR(t), ADR(t+1) . . . ADR(t+i) outputted from the address counter AC with a delay time designated by the delay time informtion DLD, whereby an amplitude data SPD (t−i) stored before the interval i is read out from an area of an address in which the amplitude data SPD(t) at the present time t is to be stored.

In other words, where the digital memory device DM has 10 words as shown in FIG. 10, the maximum value of the address interval becomes 10 so that it is possible to read out an amplitude data SPD(t−10) delayed a maximum of $10 \cdot T_o$. However, where the desired delay time is made to be $6 \cdot T_o$, for example, an address in which the address data SPD(t) sampled at the present time t is to be written is matched with an address in which an amplitude data SPD (t−i) before the interval i was stored by making the output information DM·ADR outputted from the address counter AC to be a repetition of 5, 4, 3, 2, 1; 5 . . . 0 so as to reduce the range of the addresses utilized in the digital memory device DM, thereby reading out the amplitude data SPD(t−i) written the interval i before from an address in which the amplitude data SPD(t) at the present time is to be written. To this end, in the delay circuit shown in FIG. 10, a maximum value detector MXD is provided for detecting the fact that the output information DM·ADR from the address counter AC has changed from 0 to 9 and for presetting the delay time information DLD outputted from the delay length data memory device DDM in the address counter AC.

The delay circuit shown in FIG. 10 is constructed such that instead of storing the amplitude data SPD(t) sampled at the present time t in the digital memory device DM as it is, the amplitude data SPD(t−i) before the interval i is fed back at a predetermined ratio so as to write the sum of the fed back value K·SPD (t−i) and the amplitude data SPD(t) sampled at the present time t. To this end, there are provided a multiplier M which multiplies the amplitude data SPD(t−i) read out from the digital memory device DM before the interval i with a coefficient K and feeds back the multiplied amplitude data to the data input of the digital memory device DM, and an adder AD which adds together the output data K·SPD(t−i) from the multiplier M and the amplitude data SPD (t) at the present time t and supplies the sum [SPD(t)+K·SPD(t−i)] to the data input of the digital memory device DM.

Accordingly, with the delay circuit shown in FIG. 10, where the desired delay time i is equal to $6 \cdot T_o$, the address counter AC is preset with a delay time information DLD represented by DLD=6−1=5 at a time when the output information DM·ADR of the address counter AC changes from 0 to the maximum value, in this example 9, whereby the address counter AC repeatedly outputs an address information DM·ADR which varies as 5, 4, 3, 2, 1, 0, 5, . . . 0 as the sampling time proceeds in each sampling period $T_o$. At each sampling time, the amplitude data SPD(t−i) stored before the interval i in the area of the address designated by the address information DM·ADR is firstly read out and then data [SPD(t)+K·SPD(t−j)] formed by adding together at a predetermined ratio the amplitude data SPD(t−i) and the amplitude data SPD(t) sampled at the present time t is written in the area of the address from which the amplitude value SPD (t−i) has been read out.

Accordingly, with the delay circuit shown in FIG. 10, the address in which the amplitude data SPD(t) at the present time t is written and the address from which the amplitude data SPD(t−i) before an interval i is read out are the same, and the amplitude data SPD(t−i) before the interval i is fed back so that it is possible to take out data regarding a reverberation tone whose amplitude value and the delay time vary regularly. Thus, in this embodiment, the delay circuit shown in FIG. 10 is utilized to generate a reverberation tone following an initial reflected tone (echo) and having a regular reverberation characteristic.

When the amplitude data SPD is multiplied with the coefficient K, the data regarding the finally obtained reverberation tone would have a level larger than that of the original amplitude data. Accordingly, in an actual circuit, the data regarding the reverberation tone is applied to the output side terminal through an attenuator. Where the coefficient K is selected such that $-1 \leqq K \leqq 0$, such attenuator is not necessary.

The process of forming the reverberation tone will now be described with reference to the functional block diagram shown in FIG. 8.

Process of forming the reverberation tone

The process of forming the reverberation tone in the embodiment shown in FIG. 8 comprises the step of forming an initial reflected tone whose amplitude level and delay time vary randomly and the step of forming a reverberation tone whose amplitude level and the delay time vary regularly. In FIG. 8, the initial reflected tone and the reverberation tone are formed by independent delay circuit systems.

In FIG. 8, the amplitude data SPD(t) obtained by sampling an input musical tone signal at a predetermined period $T_o$ is supplied to a first delay circuit system, that is an initial reflected tone forming unit 1, which utilizes the delay circuit shown in FIG. 9 and made up of a memory device DO having memory addresses for 2048 words, multipliers M1 through M10 respectively multiplying ten types of the amplitude data SPD(t−i), SPD(t−$i_2$) . . . SPD(t−$i_{10}$) before intervals in (n=1 to 10) which are read out from the memory device DO at the present sampling time and having different delay times with any amplitude level control coefficient $K_n$(n=1 to 10), and an adder which adds together the outputs $K_1$·SPD(t−$i_1$), $K_2$·SPD (t−$i_2$) . . . $K_{10}$·SPD(t−$i_{10}$) for producing a total sum $$\sum_{n=1}^{10} K_n \cdot SPD(t - i_n)$$

as an initial value ECH (t) of the initial reflected tone at the present time t. The adder SUM contains a register R0 which temporarily stores the sum $$\sum_{n=1}^{10} K_n \cdot SPD(t - i_n)$$

until the next sampling time (t+1).

In the initial reflected tone forming unit 1 described above, the amplitude data SPD(t) of the input musical tone at the present time t is written in the area of the address corresponding to the present time t among the memory addresses of the memory device D0 for 2048 words. Since the total sum $$\sum_{n=1}^{10} K_n \cdot SPD(t - 1 - i_n)$$

at the previous sampling time (t−1) is stored in the register R0 in the adder SUM, the content of this register RO would be reset. Then, for the purpose of reading out an amplitude data having a delay time of $i_1$ from the memory device DO among ten types of the amplitude data $SPD(t-i_1)$ through $SPD(t-_{10})$ before interval in, an address of the memory device DO corresponding to the delay time $i_1$ is designated so as to read out from that address the amplitude data $SPD(t-i_1)$ sampled $i_1$ interval before. The address of the area where the amplitude data $SPD(t-i_1)$ $i_1$ interval before is read out is calculated by equation (1).

The amplitude data $SPD(t-i_1)$ thus read out and having a delay time $i_1$ is inputted to the multiplier M1 to be multiplied with an amplitude level control coefficient $K_1$ corresponding to the first reflected tone $ECH_1$ having a delay time $i_1$. The output $K_1$. $SPD(t-i_1)$ of the multiplier M1 is supplied to the adder SUM to be added with the present value of the register R0, and the sum is stored again in the register R0. At this time, since the content of the register R0 has been reset immediately after the writing of the amplitude data SPD(t) at the present time t, the data written into the register RO at this time is the data $K_1$ $SPD(t-i_1)$.

As above described, when the processings of reading out the amplitude data $SPD(t-i_1)$ having a delay time of $i_1$ and of the level control are completed, in other words, when the processing regarding the first reflected tone $ECH_1$ is completed, processing of reading out the amplitude data $SPD(t-i_2)$ regarding the second reflected tone $ECH_2$ having a delay time of $i_2$ and of the level control are performed in the same manner as the processing of forming the first reflected tone $ECH_1$. As a consequence, the sum of the data $K_1 \cdot SPD(t-i_1)$ regarding the first reflected tone $ECH_1$ and the data $K_2 \cdot SPD(t-i_2)$ regarding the second reflected tone $ECH_2$, that is $[K_1 \cdot SPD(t-i_1+K_2 \cdot SPD(t-i_2)]$ is stored in the register R0 in the adder SUM.

Similar processings are also performed for the third reflected tone $ECH_3$ through the tenth reflected tone $ECH_{10}$. As a consequence, the total sum $$\sum_{n=1}^{10} K_n \cdot SPD(t - i_n)$$

of the amplitude data $K_1 \cdot SPD(t-i_1)$ through $K_{10} \cdot SPD(t-i_{10})$ regarding the first reflected tone $ECH_1$through the tenth reflected tone $ECH_{10}$ would be stored in the register R0, and this total sum $$\sum_{n=1}^{10} K_n \cdot SPD(t - i_n)$$

is outputted through a switch circuit SW as the instantaneous value of the initial reflected tone consisting of the first to 10th reflected tones $ECH_1$ through $ECH_{10}$.

As shown in the following Table II, the switch circuit SW selects the output of the register R0 during an interval Ta in which the initial reflected tone is formed, whereas selects and outputs the output of the second delay circuit system at a time Tb following the forming of the initial reflected tone, the sum of Ta and Tb being sampling period To.

TABLE II

| sampling period To(= Ta + Tb) | |
|---|---|
| Ta | Tb |
| formation of the initial reflected tone | formation of the reverberation tone |

The information ECH(t) selected by the switch circuit SW is converted into an analog signal by a D/A converter, not shown, and then supplied to a loudspeaker to be produced as an initial reflected tone for the input musical tone.

Figure 12:
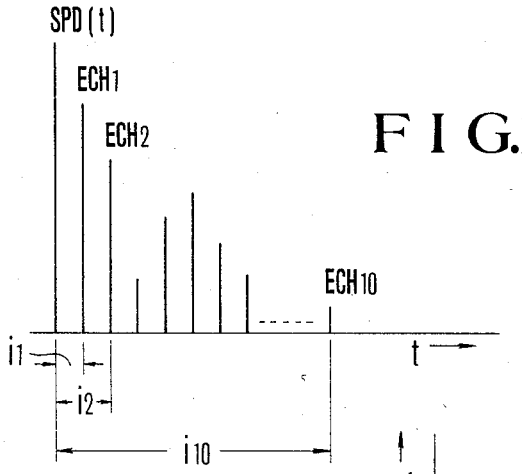
FIG. 12 is a graph showing the initial reflected tone (echo) generated in the embodiment shown in FIG. 7.

Consequently, by making different the delay times in of the first to 10th reflected tones $ECH_1$ through $ECH_{10}$ and the amplitude level control coefficients $K_n$, it is possible to produce an initial reflected tone whose amplitude level and the delay time vary randomly as shown in FIG. 12.

Where the sampling period $T_o$ of the input musical tone is 0.04 ms (25 KHz) and when an amplitude data SPD(t−1626) stored at an address spaced by 1626 words, for example, from the write address for the amplitude data SPD(t) at the present time t is read out, the delay time i becomes $$i = 1626 \times 0.04 \cong 65 \text{ ms}$$

whereby an initial reflected tone delayed about 65 ms from the input musicl tone can be produced.

The amplitude data obtained by sampling the input musical tone at a predetermined period $T_o$ is also supplied to the second delay ciruit system for forming a reverberation tone after forming the initial reflected tone.

This second delay circuit system comprises a delay memory device D10 which supplies to a digital bandpass filter BPF the amplitude data SPD (t) after delaying the same by an interval j, a bandpass filter BPF including a low pass filter LPF and a high pass filter HPF which passes only a predetermined frequency band component of the amplitude data SPD(t−j) delayed by j, a first reverberation tone forming unit 2 of a comb filter and adapted to form a reverberation tone data $RVD^1$ having a coarse delay time spacing based on the amplitude data SPD(t−j) passed through the band pass filter, and a second reverberation tone forming unit 3 having an all pass filter construction and adpted to form a reverberation tone data $RVD^2$ having a short delay time spacing based on the reverberation tone data $RVD^1$.

In the circuit shown in FIG. 8, the amplitude data SPD(t) sampled at the present time t is stored in the area of the address ADR(t) corresponding to the present time t among 2048 memory addresses of the memory device D10. For the purpose of reading out an amplitude data SPD(t−j) sampled before an interval j among a number of amplitude data SPD(t) stored in the memory device 10, an address of the memory device D10 corresponding to the delay time j is designated. The address of the area where the amplitude data SPD(t−j) sampled an interval j before is read out is determined by equation (1) in the case of forming the initial reflected tone. The delay time j at this time is selected to be slightly larger than the delay time $i_{10}$ regarding the tenth reflected tone $ECH_{10}$, that is $j > i_{10}$.

The amplitude data SPD(t−j) having the delay time j thus read out of the memory device D10 is inputted to the multiplier m11 of the low pass filter LPF to be multiplied with a predetermined coefficient $K_{11}$, and the product $K_{11} \cdot SPD(t-j)$ is temporarily stored in the register R1. Then, an amplitude data SPD(t−j−1) written one sampling time $(1 \cdot T_o)$ before is read out from the memory device SD0 having memory area of one word and then multiplied with a predetermined coefficient $K_{12}$ in the multiplier M12. Then, the output $K_{12} \cdot SPD(t-j-1)$ of the multiplier M12 and the amplitude data $K_{11}\cdot SPD(t-j)$ before interval j temporarily stored in the register R1 are added together. The sum $[K_{12}\cdot SPD(t-j-1)+K_{11}\cdot SPD(t-j)]$ is again temporarily stored in the register R1 and the register R2. Then, the amplitude data $SPD(t-j-1)$ written at a time one sampling time $(1\cdot T_o)$ before the present time t is again read out from the memory device SD and then multiplied with a predetermined coefficient $K_{13}$ in the multiplier M13. The product $K_{13}\cdot SPD(t-j-1)$ thus formed is added to a value $[K_{12}\cdot SPD(t-j-1)]$ temporarily stored in the register R2 and the sum $[K_{12}\cdot SPD(t-j-1)+K_{11}\cdot SPD(t-j)+K_{13}\cdot SPD(t-j-1)]$ is again temporarily stored in the register R2. For the purpose of utilizing the value $[K_{12}\cdot SPD(t-j-1)+K_{11}\cdot SPD(t-j)]$ temporarily stored in the register R1 in the next sampling period $(t+1)$, this value is stored in the memory device SDO.

By performing these operations at each sampling period $T_o$ an amplitude data $SPD(t-j)$ before time j and removed with high frequency components in a predetermined bandwidth is outputted from the register R2 of the low pass filter LPF and sent to the high pass filter HPF.

Then the high pass filter HPF removes low frequency components in a predetermined bandwidth from the amplitude data $SPD(t-j)$ before interval j in the same manner as in the low pass filter.

Then, the output data $SPD(t-j)$ of the register R2 of the low pass filter LPF is supplied to the multiplier M14 to be multiplied with a predetermined coefficient $K_{14}$, and the product $K_{14}\cdot SPD(t-j)$ is temporarily stored in the register R3. Then the amplitude data $SPD(t-j-1)$ written one sampling time $(1\cdot T_o)$ before is read out from the memory device SD1 having memory area of a single word and multiplied with a predetermined coefficient $K_{15}$ in the multiplier M15. The product $K_{15}\cdot SPD(t-j-1)$ thus obtained is added to the amplitude data $K_{14}\cdot SPD(t-j)$ before time j and has been temporarily stored in the register K3 and the sum $[K_{14}\cdot SPD(t-j)+K_{15}\cdot SPD(t-j-1)]$ is temporarily stored in the registers R3 and R4. The amplitude data $SPD(t-j-1)$ written at a time before one sampling time $(1\cdot T_o)$ than the present time t is again read out from the memory device SD1 and multiplied with a predetermined coefficient $K_{16}$ in the multiplier M16 and the product $K_{16}\cdot SPD(t-j-1)$ is added to $[K_{14}\cdot SPD(t-j)+K_{15}\cdot SPD(t-j-1)]$ stored temporarily in the register R4 and the sum $[K_{16}\cdot SPD(t-j-1)+K_{14}\cdot SPD(t-j)+K_{15}\cdot SPD(t-j-1)]$ is temporarily stored in the register R4. For the purpose of using the value $[K_{14}\cdot SPD(t-j)+K_{15}\cdot SPD(t-j-1)]$ temporarily stored in the register R3 in the next sampling period $(t+1)$, this value is written into the memory device SD1.

These operations are performed in each sampling period $T_o$ so as to produce the amplitude data $SPD(t-j)$ before time j and removed with low frequency components in a predetermined bandwidth from the register R4 of the high pass filter HPF.

Since the register R1 of the low pass filter LPF is not utilized until the next sampling period after writing its content into the memory device SD0, the register R3 of the high pass filter HPF can be used as the register R1.

The amplitude data $SPD(t-j)$ before the interval j and removed with the low and high frequency components in a predetermined bandwidth is inputted to the first reverberation tone forming unit 2.

Figure 13:
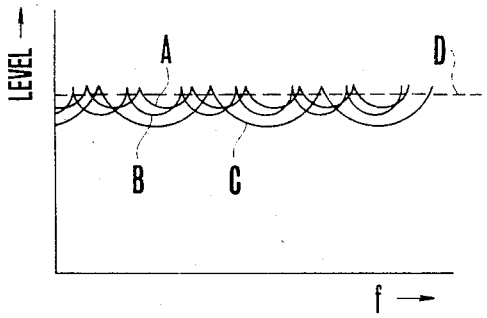
FIG. 13 shows the frequency characteristics of a comb filter.

The first reverberation tone forming unit 2 is provided with three parallelly connected delay circuits 2A, 2B and 2C of the comb filter construction. With a single delay circuit of the comb filter construction the frequency characteristic becomes wavy as shown by A, B and C in FIG. 7 so that three delay circuits 2A, 2B and 2C are connected in parallel. More particularly, parallel connection of three delay circuits 2A, 2B and 2C having different delay times flattens the overall frequency characteristic as shown by D in FIG. 13. The degree of flatness can be improved as the number of parallelly connected delay circuits increase.

In this embodiment, the delay circuit 2A has the longest delay time, the delay circuit 2B has the next delay time, and the delay circuit 2C has the shortest delay time. Although delay circuits 2A, 2B and 2C have different delay times they have the same construction. Accordingly, the construction of only the delay circuit 2A is shown in detail, but delay circuits 2B and 2C are shown only with the reference charactors of their multipliers registers and memory devices.

In the first reverberation tone forming unit 2 described above, the amplitude data $SPD(t-j)$ before time j and passed through the bandpass filter BPF is multiplied with an amplitude level control coefficient $K_{17}$ in a multiplier $K_{17}$. The product $K_{17}\cdot SPD(t-j)$ thus produced is temporarily stored in a register R5 in the multiplier M17. For the purpose of reading out amplitude data $SPD(t-x_1)$ written in a memory device D1 having memory addresses for 2048 words $x_1$ time before, an address of the memory device D1 corresponding to the delay time $x_1$ is designated. The read out amplitude data $SPD(t-x_1)$ is applied to an adder SUM where it is added to the outputs of other memory devices D2 and D3 and to the outputs of the memory devices D4 through D6 and D7 through D9 of the delay circuits 2B and 2C, and the sum is temporarily stored in a register R11 in the adder SUM. In this case, the reading operations of the memory devices D1 through D9 are sequentially performed on the time division bases in the order of from D1 to D9. Accordingly, during the reading of the memory device D1, no data is outputted from other memory devices D2 through D9. As a consequence, the data written into the register R11 in the adder SUM is the data $SPD(t-x_1)$ read out from the memory device D1.

The amplitude data $SPD(t-x_1)$ read out from the memory device D1 is multiplied with an amplitude level control coefficient $K_{13}$ in a multiplier 18 and then fed back to the input side of the memory device D1. The product $K_{13}\cdot SPD(t-x_1)$ is added to data $K_{17}\cdot SPD(t-j)$ temporarily stored in the register R5 at the present time t and the sum $[K_{17}\cdot SPD(t-j)+K_{18}\cdot SPD(t-x_1)]$ in temporarilly stored in a register R6. Then the amplitude data $[K_{17}\cdot SPD(t-j)+K_{18}\cdot SPD(t-x_1)]$ stored in the register R6 is written into the same address which is storing the amplitude data $SPD(t-x_1)$ before time $x_1$. Thereafter, the content of the register R6 is reset. The reason for resetting the register R6 is to use this register for the processing of the system including the memory device D2 in the next stage.

Upon completion of the processing of the system including the memory device D1, the processing of the system including the memory device D2 is executed in the same manner.

More particularly, for the purpose of reading out the amplitude data $SPD(t-x_2)$ written $x_2$ time before, into the memory device D2 having 2048 word addresses an address of the memory device D2 corresponding to the delay time $x_2$ is designated, thereby to read out the amplitude data $SPD(t-x_2)$ sampled $x_2$ time before from the memory device D2. This read out amplitude data $SPD(t-x_2)$ is added to the content $SPD(t-x_1)$ of a register R11 (the content read out from the memory device D1) by the adder SUM and the sum $[SPD(t-x_1)+SPD(t-x_2)]$ is temporarily stored in the register R11.

The amplitude data $SPD(t-x_2)$ read out from the memory section D2 is multiplied with an amplitude level control coefficient $K_{18}$ in a multiplier 19 and then fed back to the input side of the memory device D2. The product $K_{19}\cdot SPD(t-x_2)$ is added to the value $K_{17}\cdot SPD(t-j)$ temporarily stored in a register R5, and the sum $[K_{17}\cdot SPD(t-j)+K_{19}\cdot SPD(t-x_2)]$ is temporarily stored in a register R6. The data $[K_{17}\cdot SPD(t-j)+K_{19}\cdot SPD(t-x_2)]$ to be stored in the register R6 is stored in the same address storing the data $SPD(t-x_2)$, $x_2$ time before. Thereafter, the content of the register R6 is reset.

Thereafter, the processing of the system including the memory section D3 is executed in the same manner as that of the system including the memory device D2.

Denoting the delay time of the system including the memory device D3 by $x_3$, at the time of completing the processings of the systems including memory sections D1, D2 and D3, the data to be stored in the register R11 is expressed by $$SPD(t-x_1)+SPD(t-x_2)+SPD(t-x_3)$$

whereas the data to be stored in the memory device D3 is expressed by $$K_{17}\cdot SPD(t-j)+K_{20}\cdot SPD(t-x_3)$$

Similar processings are executed in the delay circuits 2B and 2C.

Denoting the delay times of the systems including memory sections D4, D5 and D6 of the delay circuit 2B by $x_4$, $x_5$ and $x_6$ respectively, and the delay times of the systems including memory sections D7, D8 and D9 of the delay circuit 2C by $x_7$, $x_8$ and $x_9$ respectively, then the content of the register 11 at the time when all processings of the delay circuits 2A, 2B and 2C have completed is expressed by the following equation $$\begin{aligned} RVD^1 &= \sum_{n=1}^{9} SPD(t-x_n) \\ &= SPD(t-x_1)+SPD(t-x_2)+SPD(t-x_3)+ \\ &\quad SPD(t-x_4)+SPD(t-x_5)+SPD(t-x_6)+ \\ &\quad SPD(t-x_7)+SPD(t-x_8)+SPD(t-x_9) \end{aligned}$$

Figure 14:
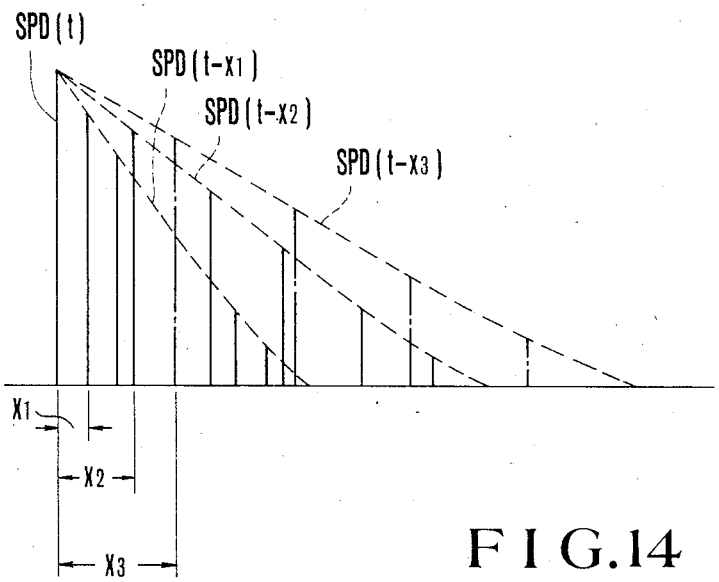
FIGS. 14 and 15 show the characteristics of the reverberations generated in the embodiment shown in FIG. 7.

Consequently, following the initial reflected tone, a reverberation tone can be obtained having a long delay time and in which the amplitude level and the delay time vary regularly as shown in FIG. 14, in which the reverberation tone of the delay circuit 2A alone is depicted for the sake of simplicity.

The reverberation tone data $RVD^1$ thus formed and having a long delay time interval is supplied to the second reverberation tone forming unit 3.

The second reverberation tone forming unit 3 is provided with serially connected delay circuits 3A, 3B and 3C of the all pass type filter construction having a flat frequency characteristic.

The three delay circuits 3A, 3B and 3C are connected in series to form a reverberation tone data $RVD^2$ having a shorter delay time interval than the reverberation tone data $RVD^1$ formed by the first reverberation tone forming unit 2. For this reason, the delay times of the delay circuits 3A, 3B and 3C of the second reverberation tone forming unit 3 are set to be shorter than the delay times of the delay circuits 2A, 2B and 2C of the first reverberation tone forming unit 2. The delay circuits 3A, 3B and 3C are set with different delay times but have the same construction. Accordingly, the construction of only the delay circuit 3A is shown in detail but delay circuits 3B and 3C are shown with the reference charactors of their multipliers, registers and memory devices.

The reverberation tone data $RVD^1$ outputted from the second reverberation tone forming unit 2 is supplied to a register R12 of the delay circuit 3A, but prior to store this data $RVD^1$ in the register R12, for the purpose of reading out $y_1$ time before data $RVD^1(t-y_1)$ written into a memory section MD0 having 512 word memory addresses, an address of the memory device MD0 corresponding to the delay time $y_1$ is designated, thus reading out the data $RVD^1(t-y_1)$ from the memory device MD0 written before the time $y_1$. The data $RVD^1(t-y_1)$ is multiplied with an amplitude level control coefficient $K_{30}$ in a multiplier M30, and the product $K_{30}\cdot RVD^1(t-y_1)$ is fed back to the input side of the memory section MD0. Then the fed back data $K_{30}\cdot RVD^1(t-y_1)$ is added to data $RVD^1(t)$ supplied from the first reverberation tone forming unit 2 at the present time and the sum $[RVD^1(t)+K_{30}\cdot RVD^1(t-y_1)]$ is temporarily stored in the register R12. Thereafter, the address of the memory section MD0 corresponding to the delay time $y_1$ is designated again and the data $RVd^1(t-y_1)$ written $y_1$time before is again read out from the memory section MDO. The read out data $RVD^1(t-y_1)$ is temporarily stored in the register R13. Then the data $[RVD^1(t)+K_{30}\cdot RVD^1(t-y_1)]$ temporarily stored in register R12 is multiplied with an amplitude control coefficient $K_{20}$ in a multiplier 29 and the product $K_{29}\cdot[RVD^1(t)+K_{30}RVD^1(t-y_1)]$ is added to a value $RVD^1(t-y_1)$ temporarily stored in the register R13. The sum $RVD^1(t-y_1)+K_{29}\cdot[RVD^1(t)+K_{30}\cdot RVD^1(t-y_1)]$ is temporarily stored in the register R13. For the purpose of utilizing the data $[RVD(t)+K_{30}\cdot RVD^1(t-y_1)]$ temporarily stored in the register R12 at a sampling time $(t+y_1)$ later than the present time t by an interval $y_1$, the data $[RVD^1(t)+K_{30}\cdot RVD^1(t-y_1)]$ is stored in the address in which the data $RVD^1(t-y_1)$ was stored.

When the processing executed by the delay circuit 3A is completed, the data $RVD^1(t-y^1)+K_{29}\cdot[RVD^1(t)+K_{30}RVD^1(t-y_1)]$ is sent to the delay circuit 3B in which this data is processed in the same manner as in the delay circuit 3A.

Denoting the output data from the delay circuits 3A, 3B and 3C by $RVD^{2A}$, $RVD^{2B}$ and $RVD^{2C}$ respectively and denoting the delay time of the delay circuit 3B by $y_2$, and the delay time of the delay circuit 3C by $y_3$, then the output data of the registers R13, R15 and R17 of the delay circuits 3A, 3B and 3C can be expressed by the followin equations (4), (5) and (6).

$$RVD^{2A}=RVD^1(t-y_1)+K_{29}\cdot[RVD^1(t)+K_{30}\cdot RVD^1(t-y_1)] \quad (4)$$

$$RVd^{2B}=RVD^{2A}(t-y_2)+K_{31}\cdot[RVD^{2A}(t)=k_{32}\cdot RVD_2(t-y_2)] \quad (5)$$

$$RVD^{2C}=RVD^{2B}(t-y_3)=K_{32}\cdot[RVD^{2B}(t)=K_{34}\cdot RVD^{2B}(t-y_3)] \quad (6)$$

Figure 15:
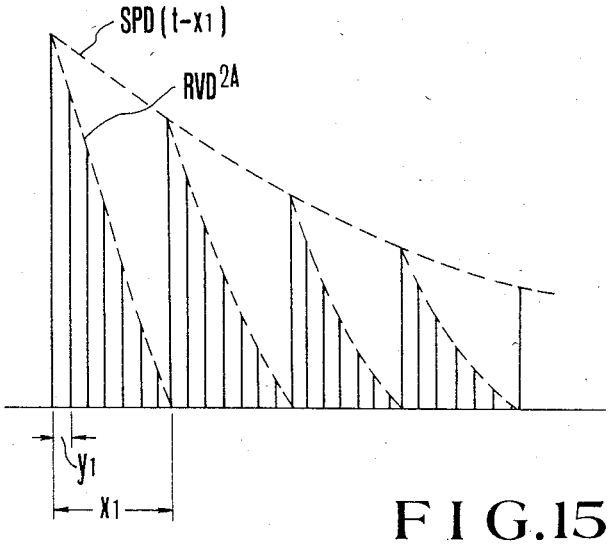

The output data $RVD^{2C}$of the delay circuit 3C is outputted via a switch circuit SW as data for producing a reverberation tone following the initial reflected tone.

Where the relation among the delay times of the delay circuits 3A, 3B and 3C is selected as $y>y_2>y_3$ it is possible to form a reverberation tone having a short delay time spacing as shown in FIG. 15. More particularly, based on the reverberation tone data $RVD^1$ formed by the first reverberation tone forming unit 2 and having a long delay time spacing, the delay circuit 3A forms a first reverberation tone data $RVD^{2A}$ having a spacing shorter than the delay timne spacing of the first reverberation tone forming unit 2, while the delay circuit 3B forms a second reverberation tone data $RVD^{2B}$ having a spacing $y_2$ shorter than the delay time spacing $y_1$ of the delay circuit 3A. For this reason, as the forming processings of the reverberation tones by the delay circuits 3A, 3B and 3C proceed, reverberation tones having shorter delay time spacings would be formed.

Since the registers R12, R14 and R16 in the delay circuits 3A, 3B and 3C are not used until the next sampling period, once the processing executed by them are completed they can be used commonly on the time division basis.

Obviously, in the delay circuits 3A, 3B and 3C, the multiplier M29 may directly receive the data RVD' or the output of the first reverberation forming unit 2 as shown at dotted line and similarly, the multiplier M30 may be connected to receive the output of the register R13.

The detail of the construction and operation of the embodiment shown in FIG. 7 will now be described. In the following description, it is assumed that the circuit shown in FIG. 7 forms the reverberation tone according to the performances described in connection with FIG. 8.

Detailed Construction of one embodiment

Figure 7:
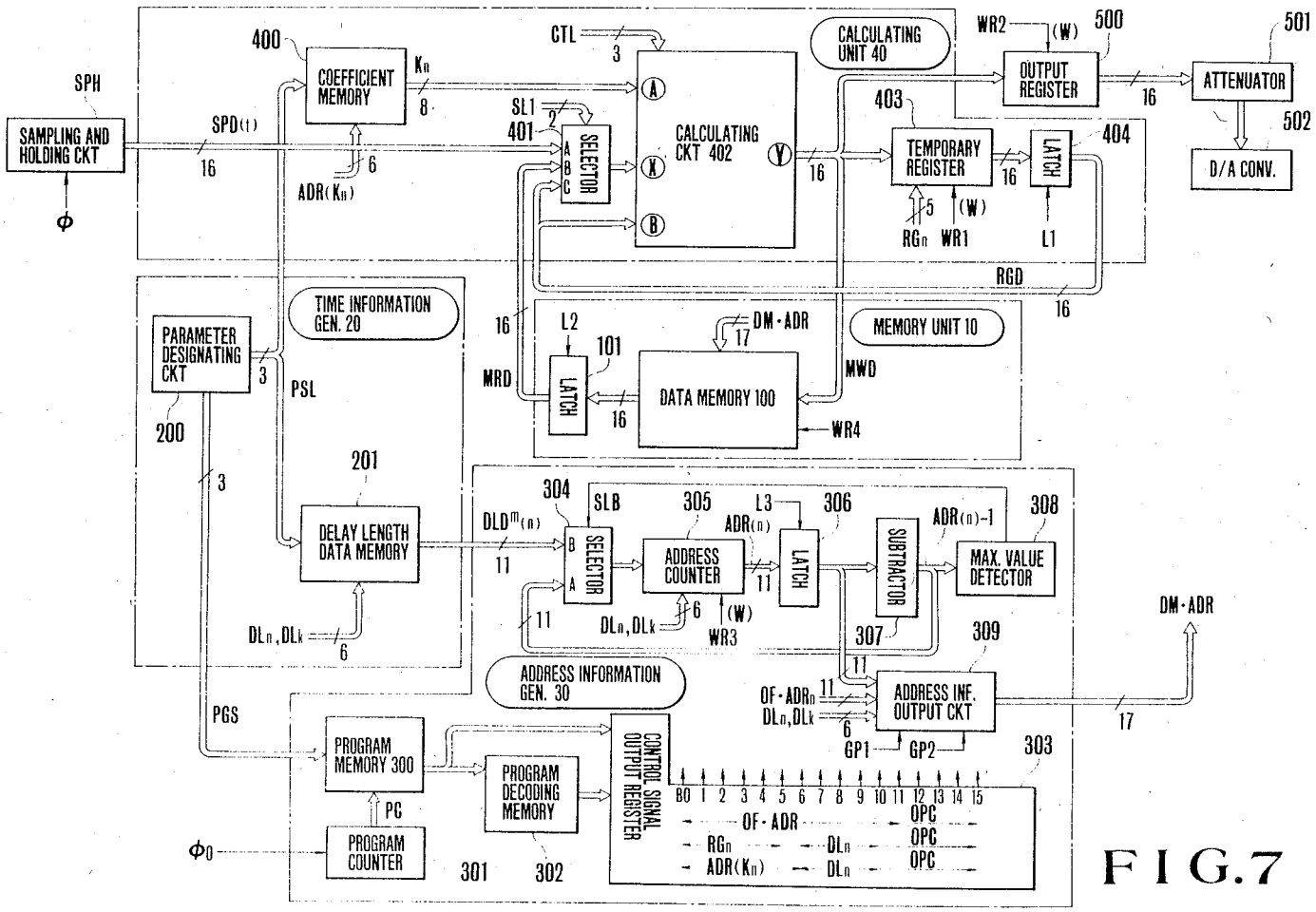
FIG. 7 is a block diagram showing one example of the reverberation tone generating apparatus utilized in this invention.

The reverberation tone generating apparatus of the embodiment shown in FIG. 7 generally comprises a memory unit 10, a time information generator 20, an address information generator 30 and a calculating unit 40.

Figure 16:
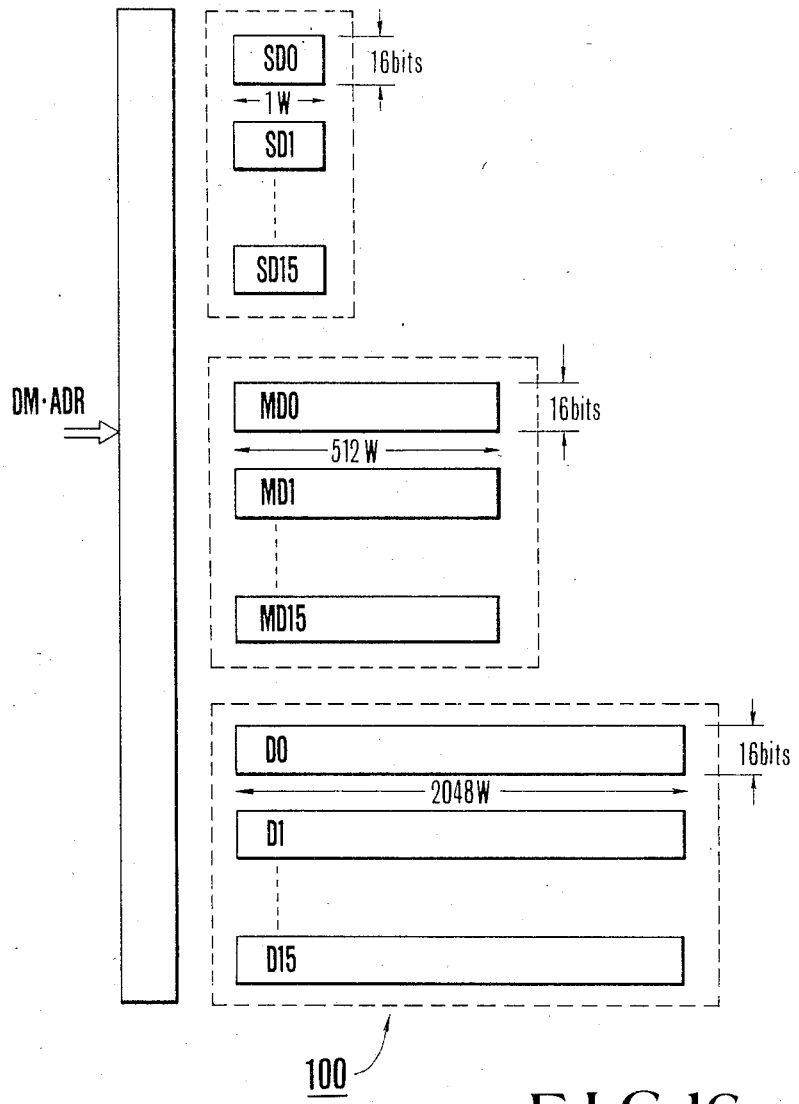
FIG. 16 shows the construction of the data memory device utilized in the embodiment shown in FIG. 7.

The memory unit 10 corresponds to the delay digital memory device DM shown in FIG. 10 and constituted by a data memory device 100 having a plurality of memory blocks and a latch circuit 101. By utilizing the plurality of memory blocks the data memory 100 includes memory sections SD0 through SD15 each for one word (16 bits), memory sections MD0 through MD15 for 512 words (each 16 bits), and memory sections D0 through D15 for 2048 words (each 16 bits) as shown in FIG. 16. The data to be stored in these memory sections SD0 through Sd15, MD0 through MD15 and D0 through D15 are given from the calculating unit 40, and a data storing address and a data read out address are designated by address informations DM·ADR outputted from an address information generator 30. Data read out from respective memory sections SD0 through SD15 are supplied to the calculating unit 40 via the latch circuit 101.

Figure 17:
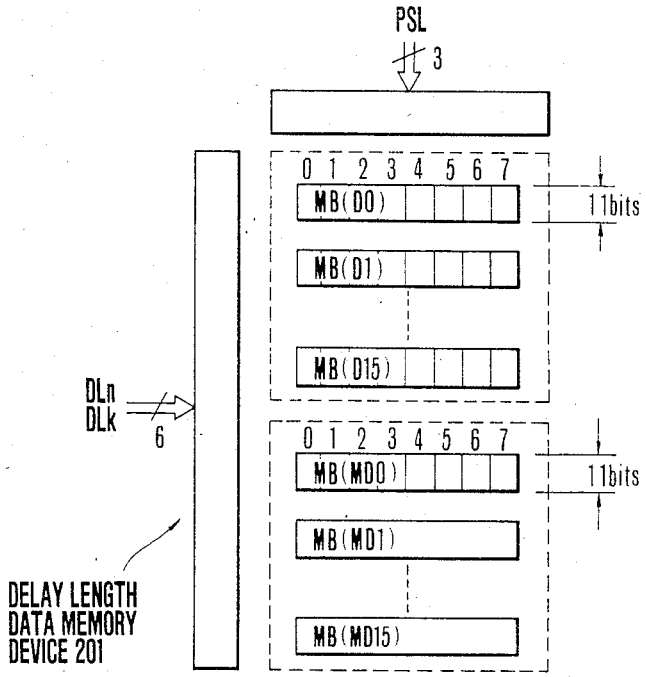
FIG. 17 shows the construction of the delay length data memory device utilized in the embodiment shown in FIG. 7.

The time information generator 20 corresponds to the delay length data memory device DDM and comprises a parameter designating circuit 200 and a delay length data memory device 201. The delay length data memory device 201 is constructed to select and output either one of the delay time informations $DLD^m(n)$ (where n designates memory sections D0 through D15 and MD0 through MD15, and m designates types 1 through 8) relating to respective data delay memory sections D0 through D15 and MD0 through MD15 respectively corresponding to 8 types of the reverberation tones (including the initial reflected tone) having different reverberation characteristics in accordance with a designation from the parameter designating circuit 200. More partcularly, as shown in FIG. 17, the delay length data memory device 201 comprises memory blocks MB(D0) through MB(D15); MB(MD0) through MB(MD15) respectively corresponding to the data delay memory sections D0 through D15 and MD0 through MDL15. Each of the memory blocks MB(D0) through MB(MD15) comprises 8 memory addresses 0 through 7 corresponding to the 8 types of the reverberation tones. Respective memory addresses 0 through 7 of the memory blocks MB(D0) through MB(MD15) prestore different ones of the delay time informations $DLD^1(D0)$ through $DLD^8(D0)$, $DLD^1(D1)$ through $DLD^8(D1)$. . . $DLD^1(D15)$ through $DLD^3(D15)$, $DLD^1(MD0)$ through $DLD^8(MD0)$, . . . $DLD^1(MD15)$ through $DLD^8(MD15)$. 3 bit parameter designation information PSL designating the reverberation tone characteristic of a reverberation tone to be generated is supplied from the parameter designating circuit 200 as a lower order address information when a bit memory number information DLn(n=0 through 15) that designate one of the memory numbers 0 through 15 of the memory secions MD0 through MD15 and a 2 bit memory type information DLK (k=D, MD, SD) that designates the type D, MD and SD of the memory sections are supplied from the address information generator 30 as upper order address informations, the delay time information $DLD^m(n)$ which has been stored in a memory address (one of 0 through n) designated by the information DSL in a memory block (one of MB(DO) through MB(MD15) designated by the informations DLn and DLk is read out and supplied to the address information generator 30 as an information that determines the delay time relation of a reverberation tone having a desired reverberation characteristic designated by the parameter designating circuit 200. The delay time of the memory sections SD0 through Sd15 is fixed to $1\cdot T_o$, so that any delay time information is not necessary for these memory sections SD0 through Sd15. In addition to the parameter designation information PSL, the parameter designating circuit 200 produces a 3 bit program selection information PGS that selects desired one of the control programs prepared for forming 8 types of the reverberation tones.

Based on the delay time information and $DLD^m(n)$ and the program selection information PGS outputted from the time information generator 20 and a master clock pulse $\phi_o$ that determines the one step period of the control program, the address information generator 30 produces an address information DM·ADR for the data memory device 100 necessary to form a reverberation tone of a desired reverberation characteristic and various control signals for controlling the operations of various circuits. The address information generator 30 comprises a program memory device 300, a program counter 301, a program decoding memory device 302, a control signal output register 303, a selector 304, an address counter 305, a latch circuit 306, a subtractor 307, a maximum value detector 308 and an address information output circuit 309.

8 types of the control programs are prestored in the program memory device 300 for forming 8 types of reverberation tones having different reverberation characteristics, and which one of the control programs is to be outputted is designated by a program selection information PGS outputted from the parameter designation circuit 200. The content of the designated program is sequentially read out at each step by the output information PC of the program counter 301 which counts the number of the master clock pulses $\phi_o$.

In order to complete in one sampling period $T_o$ all processings of the initial reflected tone forming unit 1, the bandpass filter BPF, the first reverberation tone forming unit 2 and the second reverberation tone forming unit 3, when the sampling frequency is selected to be 25 KHz, and the frequency of the master clock pulse $\phi_o$ to be 4.8 MHz, then the number of steps of one control program becomes less than 4800/25=192 and the content of the control program having 192 steps is executed at each sampling period $T_o$. As shown in the following Table III, as the control programs at respective steps, three types of contents are prepared, that is first, second and third types in which one step is constituted by a 16 bit information. The forming of the initial reflected tone, filter processing and the forming of the reverberation tone are implemented by approximately combining the sequence of these three type control programs and the contents of each bit information.

TABLE III

| Bit | Type 1 | Type 2 | | Type 3 |
|---|---|---|---|---|
| B00 | read address information of coefficient Ki ADR(Kn) (6 bits) | register number designation information RGn (5 bits) | | offset address information of OF · ADRn |
| 01 | | | | |
| 02 | | | | |
| 03 | | | | |
| 04 | | | | |
| 05 | | SL0 | "0"=initial reflected tone<br>"1"=reverberation tone | offset address information of OF · ADRn |
| 06 | designation information DLn (6 bits) of delay circuit control information OPC (4 bits) | designation information DLn (6 bits) of delay circuit control information OPC (4 bits) | | |
| 07 | | | | |
| 08 | | | | |
| 09 | | | | |
| 10 | | | | |
| 11 | | | | |
| 12 | | | | control information OPC (5 bits) |
| 13 | | | | |
| 14 | | | | |
| B15 | | | | |

In this example, the one step control programs each consisting of 16 bits can be classified into two types, one outputted through the control signal output register 303 as they are as informations OF·ADRn, RGn, DLn, and ADR(kn) and the other outputted through the control signal output register after being decoded by the program decoding memory device 302 as the memory write control signal WR1, the latter type signal being applied to the program decoding memory device 302 from the program memory device 300 to act as an operation code OPC. The content of Table II will be described later in detail together with the operation.

Figure 18:
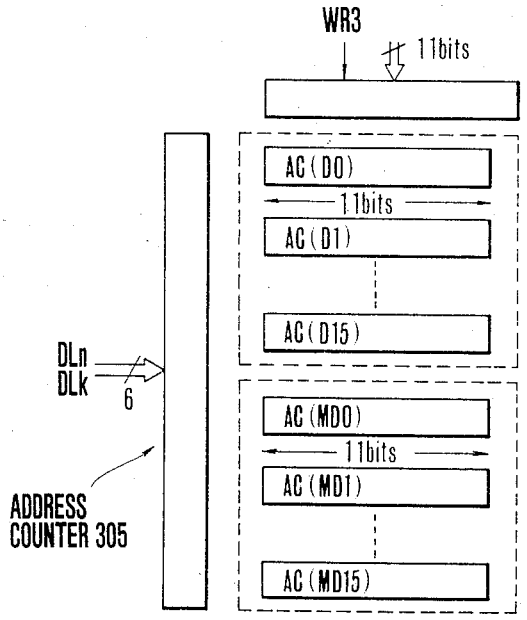
FIG. 18 shows the construction of the address counter utilized in the embodiment shown in FIG. 1.

As shown in FIG. 18, the address counter 305 comprises address counters AC(D0) through AC(D15), AC(MD0) through AC(MD15) respectively corresponding to delay memory sections D0 through D15, MD0 through MD15. Respective counters AC(D0) through AC(D15) and AC(MD0) through AC(MD15) of the address counter 305 are selectively actuated by a memory number information DLn and a memory type information DLk. The count output informations ADR(n) of the address counters AC(n)(n: D0 through D15, MD0 through MD15) which are actuated by informations DLn and DLk are supplied to the address information output circuit 309 through the latch circuit 306 and also to the subtractor 307. In this example, the output informations ADR(n) of the address counters AC(n) is constituted by 11 bits so that they can designate an address range up to 2048 words, because memory sections D0 through D15 among the memory sections D0 through D15 and MD0 through MD15 are constructed to have an address information length of 2048 words. The address counter 305 is constituted by a RAM.

The subtractor 307 subtracts [1] from the output content ADR(n) of the address counters AC(n) inputted via the latch circuit 306 and feeds back the difference [ADR(n)−1] to the A input of the selector 304 for the purpose of using the difference in the next sampling period (t+1). At the same time, the difference is also supplied to the maximum detection circuit 308 which corresponds to the detector MXD shown in FIG. 10. When the maximum value detection circuit 308 detects the fact that an information [ADR(n)−1] obtained by subtracting [1] from the output information ADR(n) of the address counter AC(n) designated by the memory number information DLn and the memory type information DLk has reached the maximum value (all bits are "1"), the maximum value detection circuit 308 applies a selection control signal SLB to the selector 304 causing the same to select the input B. The output information [ADR(n)−1] of the subtractor 307 is inputted to the input A of the selector 304, and the output information $DLD^m(n)$ of the delay length data memory data memory device 201 is inputted to the input B of the selector 304 so that its output is supplied to one input of the address counter 305 so as to be written (preset) in an address counter AC(n) designated by informations DLn and DLK in accordance with a write control signal WR3. Consequently, under a condition in which the maximum value detection circuit 308 does not produce any selection control signal SLB, a value [ADR(n)−1] obtained by subtracting [1] from the present value ADR(n) would be written in the address counter AC(n) designated by informations DLn and DLk, at each sampling period, so that the output information ADR(n) of the address counter AC(n) decreases toward zero as the time elapses. However, when the value [ADR(n)−1] reaches the maximum value, the maximum value detection circuit 308 produces a selection control signal so that a delay time information $DLD^m(n)$ is applied to the address counter AC(n) via the selector 304 and written into the address counter AC(n) in accordance with the write control signal WR3. Consequently when the selector control signal SLB is generated, the content of the address counter AC(n) becomes $DLD^m(n)$ and then sequentially changes toward zero as the sampling time elapses. In other words, in a portion constituted by a selector 304, an address counter 305, the latch circuit 306, the subtractor 307 and the maximum value detection circuit 308, the address counter AC(n) designated by the informations DLn and DLk forms an address information ADR(n) that completes one cycle with a period equal to a delay time corresponding to the delay time information $DLD^m(n)$. The address information ADR(n) is supplied to the address information output circuit 309.

The purpose of the address information output circuit 309 is to output address informations for reading out and writing informations into the memory sections SD0 through SD15, D0 through D15 and MD0 through MD15. Where an information delayed by an interval in is read out from the memory section D0 to form an initial reflected tone ECH(t), the address information output circuit 309 formes one set of informations OF·ADRn, DLn, and DLk and outputs this set as an address information DM·ADR by utilizing an 11 bit address information OF·ADRn corresponding to respective delay times in of the first to 10th reflected tones $ECH_1$through $ECH_{10}$ (outputted by the control signal output register 303) as a lower order address information and then adding a memory number information DLn and a memory type information DLk. Where an amplitude data SPD(t) sampled at the present time is to be written into the memory section D0, the address information output circuit 309 outputs a set of informations ADR(D0), DLn and DLk as an address information DM·ADR, the set being formed by utilizing the output information ADR(D0) of the address counter AC(D0) corresponding to the memory section D0 as a lower order address information and then adding informations DLn(=DL0) and DLk(=DL0) that designate the memory section $D_o$ to the upper order. When an amplitude data is written into and read out from the memory sections SD0 through SD15, all bits of a lower order address information are made "0" and informations DLn(=$DL_0$ to $DL_{15}$) and DLk (=$DL_{SD}$)designating memory sections SD0 through SD15 are added to an upper order to form and output an address information DM·ADR. Where reverberation tones $RVD^1$ and $RVD^2$ are to be formed, the output informations ADR(D1) through ADR(D15) and ADR(MD0) through ADR(MD15) of respective address counters AC(D1) through AC(D15) and AC(MD0) through AC(MD15) respectively corresponding to memory sections D1 through D15 and MD0 through MD15 are utilized as the lower order informations and informations DLn and DLk are added to their upper orders. These one set of informations ADR(n), DLn and DLk are outputted as an address information DM·ADR. In this case, at a time when the information OF·ADRn is to be added to the lower orders of the information DLn and DLk, the control signal output register 303 outputs a control pulse GP1. When all bits of the lower address information to be added to the lower orders of the informations DLn and DLk are to be made to "0", the control signal output register 303 produces a control pulse GP2. The address information output circuit 309 contains therein a register that temporarily stores informations DLn and DLk.

The purpose of the calculating unit 40 is to effect amplitude level control of the data to be stored in memory sections D0 through D15, MD0 through MD15 and SD0 through SD15 and of the data read out from respective memory sections. The calculating unit 40 comprises a coefficient memory device 400, a selector 401, a calculating or operation circuit 402, a temporary register 403 and a latch circuit 404.

Similar to the delay length data memory device, the coefficient memory device 400 includes 8 memory blocks corresponding to 8 types of the reverberation tones having different reverberation characteristics and respective memory blocks prestore a set of coefficients Kn (n=1 to 32) necessary to form reverberation tones of different types. When supplied with a parameter designation information PSL from the parameter designation circuit 200, and an address information ADR(Kn) designating the coefficient Kn, among the memory blocks designated by the information PSL, a coefficient Kn is read out from an address designated by the information ADR(Kn) and supplied to an input A of the calculating circuit 402.

The amplitude data SPD(t) of the input musical tone sampled by a sample and hold circuit SPH is inputted to the input A of the selector 401 data MRD read out from the memory device 10 is inputted to the input B and the output data RGD of the temporary register 403 is supplied to the input C via the latch circuit 404. Either one of these input data SPD(t), MRD and RGD is selected by a selection control signal SL1 (2 bits) and then applied to the input X of the calculating circuit 402.

A coefficient Kn read out from the coefficient memory device 400 is applied to the input A of the calculating circuit 402, and the output data RGD from the temporary register 403 is inputted to the input B through the latch curcuit 404 and data SPD(t), MRD, RGD selected by the selector 401 are applied to the input X so that the calculating circuit 402 performs the following calculations in accordance with a calculation control signal CTL (3 bits) outputted from the control signal output registre 303.

$$(Y)=(A)\cdot(X)+(B) \quad (7\text{-}1)$$

$$(Y)=(X)+(B) \quad (7\text{-}2)$$

$$(Y)=(X) \quad (7\text{-}3)$$

$$(Y)=(B) \quad (7\text{-}4)$$

$$(Y)=(0) \quad (7\text{-}5)$$

The results (Y) of calculations are supplied to the temporary register 403, the memory device 10 and the output register 500.

The temporary register 403 temporarily stores the values calculated by the calculating circuit 402 while the initial reflected tone ECH(t) and the reverberation tones $RVD^1$ and $RVD^2$ are being formed, and feeds back its content to the input C of the selector 401 and the input B of the calculating circuit 402 to act as the register output data RGD. The temporary resistor 403 has 32 registers R0 through R31 designated by register designation informations RGn (n=1 to 32) of a 5 bit construction and the input data are written into registers R0 through R31 designated by the informations RGn under the control of the write control signal WR1.

The output register 500 stores the instantaneous value ECH(t) of the initial reflected tone obtained as a value Y calculated by the calculating circuit 402 and the instantaneous value RVD(t) of a reverberation tone following the initial reflected tone under the control of a control signal WR2 and supplies the data thus stored to a D/A converter 502 via an attenuator 501.

The selection control signal SL1 applied to the calculation control signal CTL applied to the calculation circuit 402 are contained in an operation code OPC outputted from the control signal output register 303.

The reverberation tone generating apparatus described above operates as follows.

Operation (a) Formation of the initial reflected tone FCH(t).

(1) For the purpose of writing the amplitude data SPD(t) of an input musical tone sampled at the present time t into the memory device D0, a selection control signal SL1 and the calculation control signal CTL respectively represented by

SL1: SELECT(A)

CTL: (Y)=(X)

are outputted from the control signal output register 303 as an operation code OPC, whereby the selector 401 supplies the amplitude data SPD(t) outputted from the sample and hold circuit SPH to the input X of the calculating circuit 402. The calculating circuit 402 outputs the amplitude data SPD(t) inputted to its input A as a calculated value (Y).

(2) Then after an address of the memory device D0 corresponding to the present sampling time t has been designated, for the purpose of writing the output data SPD(t) of the calculating circuit 402 into the designated address a memory type information DLk, a write control signal WR4 and a latch control signal L3 respectively represented by DLn: $DL_0$ $DL_K$: $DL_D$

WR4: "1" (WRITE)

L3: "1" (LATCH)

are outputted :rom the control signal output register 303 together with a memory number information DLn.

Accordingly, the output information ADR(D0) of the address counter AC(D0) corresponding to the memory device D0 is latched by the latch circuit 306 as a lower order address information for writing the amplitude data SPD(t) at the present time t. In the address information output circuit 309, to the upper order of the lower order address information ADR(D0) is added the memory number information DLN ($=DL_0$) and the memory type information DLk ($=DL_D$) to form a write address information DM·ADR of the amplitude data SPD(t) for the memory device D0, and the formed write address information is outputted. As a consequence the amplitude data SPD(t) at the present time t applied to the data input of the memory device D0 via the calculating circuit 402 is written into an address corresponding to the present time t by the write control signal WR4.

(3) Then, for the purpose of clearing the register R0 storing the synthesized value of the initial reflected tones at respective sampling times, an operation control signal CTL, a write control signal WR1 acting as operation codes and respectively expressed by

CTL: (Y)=0

WR1: "1" (WRITE)

are outputted from the control signal output register 303 together with a register number information RGn expressed by RGn=R0.

Consequently [0] is written into the register R0. In other words, the register R0 is cleared.

(4) Then, for the purpose of forming the first reflected tone $ECH_1$, a memory type information DLk, a control pulse GP1 and a latch control signal L2 acting as operation codes and respectively expressed by DLk: $DL_D$

GP1: "1"

L2: "1" (LATCH)

are outputted from the control signal output register 303 together with an address information OF·ADRn $=OF\cdot ADR_1$ corresponding to the delay time $i_1$ of the first reflected tone $ECH_1$. In this case, the address information output circuit 309 is storing the memory number information DLn ($=DL_0$) at the step (3).

Consequently, the address information output circuit 309 outputs an address information DM·ADR for reading out from the memory device D0 the amplitude data $SPD(t-i_1)$ written before an interval $i_1$ by utilizing the address information $OF\cdot ADR_1$ corresponding to the delay time $i_1$ as a lower order information, and by utilizing the memory number information DLn ($=DL_0$) and the memory type information DLk ($=DL_D$) as the upper order address information, whereby an amplitude data $SPD(t-i_1)$, an interval $i_1$ before is read out from the memory device and the amplitude data $SPD(t-i)$ thus read out is latched by the latch circuit by a latch control signal L2.

(5) For the purpose of transferring the present value of the register R0 to the latch circuit 404 a latch control signal L1="1" (LATCH) acting as an operation code and a register number information RGn=R0 are outputted from the control signal output register 303, whereby the present value of the register R0 is transferred to the latch circuit 404 to be stored therein.

(6) Then for the purpose of obtaining an instantaneous value $K_1\cdot SPD(t-i_1)$ regarding the first reflected tone $ECH_1$ by multiplying an amplitude data $SPD(t-i_1)$ before time $i_1$ with an amplitude level controlling coefficient $K_1$, a select control signal SL1=SELECT(B) and an calculation control signal CTL=(A)·(X)+(B)=(Y) which constitute an operation code are outputted from the control signal output register 303 together with a constant reading out address information ADR (Kn)=ADR·($K_1$).

Consequently, a coefficient $K_1$ regarding the first reflected tone $ECH_1$ is read out from the coefficient memory device 400 and supplied to the input A of the calculating circuit 402. On the other hand, the selector 401 selects the amplitude data $SPD(t-i_1)$, $i_1$ time before and supplied to its input B from the latch circuit 101 and applies the selected data $SPD(t-i_1)$ to the input X of the calculating circuit 402 which performs the following calculation.

$$(Y)=(A)\cdot(X)+(B)=K_1\cdot SPD(t-i_1)+[R0]$$

Since the content of the register R0 has been cleared at step (3) described above, at this time, an instantaneous value $K_1\cdot SPD(t-i_1)$ regarding the first reflected tone ECH is obtained as the calculated value (Y) of the calculation circuit 402.

(7) Then, for the purpose of transferring the instantaneous value $K_1\cdot SPD(t-i_1)$ of the first reflected tone $ECH_1$ to the register R0 and to store therein a write control signal WR1="1" (WRITE) acting as the operation code OPC is, outputted from the control signal output register 303 together with a register number information RGn=R0, whereby the output data $(Y)=K_1\cdot SPD(t-i_1)$ of the calculation circuit 402 is written into the register R0.

When various steps described above are completed, the instantaneous value $K_1\cdot SPD(t-i_1)$ of the first reflected tone $ECH_1$ can be obtained.

(8) Then the instantaneous values $K_2 \cdot SPD(t-i_2)$ through $K_{10} \cdot SPD(t-i_{10})$ respectively regarding the second to 10th reflected tones $ECH_2$ through $ECH_{10}$ are formed at steps (4) through (7) as a consequence at a time when the step regarding the 10th reflected tone $ECH_{10}$ has completed, the register R0 stores the total sum $\epsilon_{n-1}{}^{10}$ Kn SPD(t−i) of the instantaneous values of the first to 10th reflected tones $ECH_1$ through ECH $_{10}$, and the total sum is written into the output register 500 by the write control signal WR2 and then transferred to the attenuator 501.

(b) Filter operation.

(1) For the purpose of reading out from the memory device D10 the amplitude data SPD(t−j), j time before, a memory type information $DLk=DL_D$, latch control signals L3="1" (LATCH) and L2="1" (LATCH) which constitute the operation code OPC are outputted from the control signal output register 303 together with a memory number information $DLn=DL_{10}$.

From the address counter AC(D10) corresponding to the memory section D10 is latched by the latch circuit 306 as a lower order address information for reading out the amplitude data SPD(t−j), j time before. The lower order address information ADR(D10) thus latched is added to its upper order the memory number information DLn ($=DL_{10}$) and the memory type information DLk ($=DL_D$) in the address information output circuit 309 to form a read address information DM·ADR for reading out the amplitude data SPD(t−j) from the memory section D10 of the data memory device 100, whereby the amplitude data SPD(t−j), an interval j before, is read out from the memory section D10 and the read out data is latched by the latch circuit 101 according to the latch control signal L2.

(2) For the purpose of writing the amplitude data SPD (t) sampled at the present time t into the same address from which the amplitude data SPD(t−j) has been read out, a selection control signal SL1=SELECT(A) and a calculation control signal CTL=(Y)=(X) which constitute the operation code are outputted from the control signal output register 303. Consequently, the selector 401 supplies to the input X of the calculation circuit 402, amplitude data SPD(t) outputted from the sample and hold circuit SPH. Furthermore, the calculation circuit 402 outputs the amplitude data SPD(t) inputted to its input X as a calculated value (Y).

(3) For the purpose of writing the amplitude data SPD(t) into the memory section D10 a memory type information $DLk=DL_D$, a write control signal WR4="1" (WRITE), and a latch control signal L3="1" (LATCH) which constitute the operation code OPC, and a memory number information DLn=DL10 are outputted from the control signal output register 303. Accordingly, the output information ADR(D10) of the address counter AC(D10) corresponding to the memory section D10 is latched by the latch circuit 306 as a lower order address information for writing the amplitude data SPD(t) at the present time t. In the address information output circuit 309, to the lower order address information ADR(D10) thus latched are added the memory number information DLn($=DL_{10}$) and the memory type information DLk ($=DL_D$) to form and output an address information DM·ADR for writing the amplitude data SPD(t) in the memory section D10. As a consequence, the amplitude data SPD(t) at the present time t applied to the data input of the memory section D10 via the calculation circuit 402 is written into an address corresponding to the present time t by the write control signal WR4.

(4) Then, in the low pass filter LPF, the following equation $$[R1]+K_{11} \cdot SPD(t-j)$$

is calculated according to the content of the register R1, the coefficient $K_{11}$ and the amplitude data SPD(t−j), j time before. For storing again the calculated value in the register R1, a latch control signal L1="1" (LATCH) acting as the operation code OPC and a register number control signal RGn=R1 are outputted from the control signal output register 302 and the content of the register R1 is transferred to the latch circuit 404.

(5) For the purpose of calculating $K_{11} \cdot SPD(t-j)$, the control signal output register 303 outputs a selection control signal SL1 (SELECT (B)) and a calculation control signal CTL which constitute the operation code OPC and a constant read out address information ADR (Kn).

Consequently, a coefficient $K_{11}$ is read out from the coefficient memory device 400 and supplied to the input A of the calculating circuit 402. The selector 401 selects the amplitude data SPD(t−t) which was latched in the latch circuit 101 at the preceding step(b)- (1) and supplies the selected data SPD(t−j) to the input X of the calculation circuit 402. Accordingly, the calculation circuit 402 calculates the following equation $$\begin{aligned}(Y) &= (A) \cdot (X) + (B) \\ &= K_{11} \cdot SPD(t-j) + R1\end{aligned}$$

At this time, since the content of the register R1 has been cleared at a time when the filtering processing at the previous sampling time (t−1) has completed, data $K_{11}$. SPD(t−j) is obtained as the calculated value (Y) at this step.

(6) For the purpose of storing this calculated value (Y) $=K_{11} \cdot SPD(t-j)$ in the register R1, the control signal output register 303 outputs a write control signal WR1="1"(WRITE) utilized as the operation code OPC and a register number informatin RGn=R1, whereby the output data $K_{11} \cdot SPD(t-j)$ of the calculation circuit 402 is stored in the register R1.

(7) Then for the purpose of reading out the amplitude data SPD(t−j−l), a (j−l) interval before, the control signal output register 303 outputs a memory type information $DL_K=DL_{SD}$, a latch control signal L2="1"(LATCH), and a gate pulse signal GP2="1" which constitute the operation code OPC, and a memory number signal $DLn=DL_O$. Then the address information output circuit 309 changes to "0" all bits of the lower order address information and adds the memory type information DLk ($=DL_{SD}$) and the memory number information DLN ($=DL_o$) to the upper order to form and output an address information DM·ADR for the memory section SD0, whereby the amplitude data SPD(t−j−l), a (j−l) time before, is read out from the memory section SD0 and latched by the latch circuit 101.

(8) Then an equation $$K_{12} \cdot SPD(t-j-l)+[R1]$$

is calculated in accordance with the content $K_{11}$. SPD(t−j) of the register R1, the coefficient $K_{12}$, and the amplitude data SPD(t−j−1) latched in the latch circuit 101, and for the purpose of storing again the calculated value in the register R1, the control signal output register 303 outputs a latch control signal L1="1" (LATCH) acting as the operation code OPC and a register number information RGn=R1 so as to transfer the content $K_{11}$·SPD(t−j) of the register R1 to the latch circuit 404.

(9) Then, for the purpose of calculating an equation $K_{12}$·SPD(t−j−1)+[R1]

the control signal output register 303 outputs a signal SL1=SELECT (B) and a signal CTL=(Y)=-(A)·(X)+(B) which constitute the operation code OPC and an address information ADR(Kn)=ADR($K_{12}$), whereby a coefficient $K_{11}$ is read out from the coefficient memory device 400 and then applied to the input of the calculation circuit 402. The selector 401 selects the amplitude data SPD(t−j−1) latched in the latch circuit 101 and supplies it to the input x of the calculation circuit 402. Hence this circuit 402 outputs the result of calculation (Y) of the following equation $$\begin{aligned}(Y) &= (A)\cdot(X)+(B)\\ &= K_{12}\cdot SPD(t-j-1)+K_{11}\cdot SPD(t-j)\end{aligned}$$

This calculated value Y is stored in the resisters R1 and R2 in the next step so that their contents are changed as follows.

$$[R1]=[R2]=K_{12}\cdot SPD(t-j-1)+K_{11}\cdot SPD(t-j)$$

(10) For the purpose of calculating an equation $K_{13}$·SPD(t−j−1)+[R2] by utilizing the content of the register R2, the coefficient $K_{12}$, and the amplitude data SPD(t−j−1), a (j−1) before and stored in the memory section SD0, the amplitude data SPD(t−j−1) is read out from the memory section SD0 and latched in the latch circuit 101 in the same manner as in steps (b)-(7).

(11) In the same manner as the step (b)-(8), the content $K_{12}$·SPD(t−j−1)+$K_{11}$·SPD(t−j) of the register R2 is transferred to the latch circuit 404.

(12) Then for the purpose of reading out the coefficient $K_{13}$ to calculate an equation $K_{13}$·SPD(t−j−1)+[R2], the control signal output register 303 outputs a signal SL1=SELECT(B), and CTL=(Y)=(A)·(X) +(B) which constitute the operation code OPC and an address information ADR(Kn)=ADR($k_{13}$), whereby a coefficient $K_{11}$ is read out from the coefficient memory device 400 and supplied to the input A of the calculation circuit 402. The selector 401 selects the amplitude data SPD(t−j−1) latched in the latch circuit 101 and supplies it to the input X of the calculation circuit 402, whereby it calculates an equation $$\begin{aligned}(Y) &= (A)\cdot(X)+(B)\\ &= K_{13}\cdot SPD(t-j-1)+K_{12}\cdot SPD(t-j-1)\\ &= K_{11}\cdot SPD(t-j)\end{aligned}$$

This calculated value (Y) is stored in the register R2 at the next step and then applied to the high pass filter HPF from this register R2.

(13) At the last step of the low pass filter LPF, for the purpose of writing the content of the register R1 in the memory section SD0 for use at the next sampling time (t+1), at first the content $K_{12}$·SPD(t−j−1)+$K_{11}$·SPD(t−j) of the register R1 is transferred to the latch circuit 404 in the same manner as the step (b)-(8) for causing the operation circuit 402 to calculate (Y)=(B). The calculated value (Y)=$K_{12}$·SPD(t−j−1)+$K_{11}$·SPD(t−j) is written in the memory section SD0. This writing operation is performed by outputting the operation code OPC constituted by DLk=$DL_{SD}$, GP2="1" and WR4="1", and a memory number information DLn=$DL_o$ from the control signal output register 303.

After the operation of the low pass filter LPF completes, the high pass filter HPF operate in the same manner.

The formation of a reverberation tone $RVD^1$ having a large delay time interval will now be described.

(c) Formation of the reverberation tone $RVD^1$.

(1) At first, the data SPD(t−j) stored in the register R4 of the high pass filter HPF is multiplied with a coefficient $K_{17}$ and for the purpose of storing the product $K_{17}$·SPD(t−j) in the register R5, a latch control signal L1="1" (LATCH), and a register number information $RG_n$ are outputted from the register 303 and the content SPD(t−j) of the register R4 is transferred to the latch circuit 404.

(2) Then for the purpose of calculating data $K_{17}$·SPD(t−j) the control signal output register 303 outputs a selection control signal SL1=SELECT(c), a calculation control signal CTL=(Y)=(A)·(X) and a coefficient read address information ADR(Kn)=ADR($K_{17}$), whereby a coefficient $K_{17}$ is read out from the coefficient memory device 400 and applied to the input A of the calculation circuit. The selector 401 selects the data SPD(t−j) latched in the latch circuit 404 and applies it to the input X of the calculation circuit 402, whereby the calculation circuit calculates the following equation $$(Y)=(A)\cdot(X)=K_{17}\cdot SPD(t-j)$$

and this calculated value Y is stored in the register R5 in the next step.

(3) Then, for the purpose of reading out the amplitude data SPD(t−$x_1$), $x_1$ interval before from the memory device D1, adding the read out data to the present value of the register R11 and storing again the sum in the register R11, the control signal output register 303 outputs a latch control signals L3="1" (LATCH) and L2="1" (LATCH) a memory number information DLn=$DL_1$ and a memory type information DLk=$DL_D$, whereby the output information ADR(D1) of the address counter AC(D1) corresponding to the memory section D1 would be latched in the latch circuit 306 as a lower order information for reading out the amplitude data SPD(t−$x_1$). The memory number information DLn and the memory type information DLk are added to the upper order of the lower order address information ADR(D1) to form an address information DM·ADR for the memory section D1 of the data memory device 100. Consequently, the amplitude data SPD(t−$x_1$), $x_1$ time before is read out from the memory section D1 and latched by the latch circuit 101.

(4) To add together the read out data SPD(t−$x_1$) and the present value of the register R11, the content of the register R11 is transferred to the latch circuit 404 and thereafter the control signal output register 303 outputs a selection control signal SL1=SELECT(B) and a calculation control signal CTL=(Y)=(X)+(B).

Then the selector 401 selects the amplitude data SPD(t−$x_1$) latched in the latch circuit 101 and supplies it to the input X of the calculation circuit 402, whereby the calculation circuit 402 calculates an equation $$(Y)=(X)+(B)=[\mathrm{R11}]+\mathrm{SPD}(t-x_1)$$

Before this time, the content of the register R11 has ben cleared at a time when the operation at the preceding sampling time (t−1) was completed, so that the calculated value Y at this step (4) is equal to $\mathrm{SPD}(t-x_1)$. Thereafter, the calculated value Y is transferred to the register R11 to be stored therein.

(5) Then, for the purpose of reading out the amplitude data $\mathrm{SPD}(t-x_1)$ from the memory device D1, multiplying the amplitude data with a coefficient $K_{18}$, and for storing again the sum of the product $K_{18}\cdot\mathrm{SPD}(t-x_1)$ and the content $K_{17}\cdot\mathrm{SPD}(t-j)$ of the register R5 in the register R6, the content $K_{17}\cdot\mathrm{SPD}(t-j)$ of the register R5 is transferred to the latch circuit 404 in the same manner as in the step (c)-(1).

(6) Then, for the purpose of calculating equation $$(Y)=K_{18}\cdot SPD(t-x_1)+K_{17}\cdot SPD(t-j)$$

based upon the the amplitude data $\mathrm{SPD}(t-x_1)$ latched by the latch circuit 101, the data latched by the latch circuit 404 and the coefficient $K_{18}$, the control signal output register 303 outputs a selection control signal SL1 =SELECT(B), a calculation control signal CTL=(Y)=(A)·(X)+(B), and a coefficient read out information ADR(Kn) =ADR($K_{18}$), whereby the coefficient $K_{18}$ is read out from the coefficient memory device 400 and applied to the input A of the calculation circuit 402. On the other hand, the selector 401 selects the amplitude data $\mathrm{SPD}(t-x_1)$ latched by the latch circuit 101 and applies it to the input X of the calculation circuit 402, whereby this calculation circuit calculates an equation $$\begin{aligned}(Y) &= (A)\cdot(X)+(B)\\ &= K_{18}\cdot SPD(t-x_1)+K_{17}\cdot SPD(t-j)\end{aligned}$$

This calculated value Y is written into an address of the memory section D1 corresponding to the present time t via the register R6 in the next step. Thereafter, the register R6 is cleared for processing a system including the memory section D2.

(7) Then the processings regarding the systems respectively including memory sections are executed in the same manner as steps (c)-(3) through (c)-(6). Upon completion of the processings of respective systems respectively including memory sections D1 through D9, the register R11 produces an information regarding a reverberation tone $\mathrm{RVD}^1$ represented by $$RVD^1(t)=\sum_{n=1}^{9} SPD(t-x_n)$$

The operation of forming a reverberation tone $\mathrm{RVD}^2$ having a short delay time interval will now be described.

(d) Formation of the reverberation tone $\mathrm{RVD}^2$, (1) For the purpose of reading out the amplitude data $\mathrm{RVD}^1(t-y_1)$ from the memory section MD0, the control signal output register 303 outputs a latch control signal L3="1" (LATCH) and L2="1" (LATCH), a memory number information DLk=$\mathrm{DL}_{MD}$ and a memory type information DLk =$\mathrm{DL}_{MD}$. Consequently, in the same manner as the step (c)-(3), an address information DM·ADR for the memory section MD0 is formed in the address information output circuit 309 for reading out the amplitude data $\mathrm{RVD}^1(t-y_1)$, a $y_1$ time before, from the memory section MD0. This read out data $\mathrm{RVD}^1(t-y_1)$ is latched by the latch circuit 101.

(2) The, data $$K_{30}\cdot RVD^1(t-y_1)+RVD^1(t)$$

is calculated by using the amplitude data $\mathrm{RVD}^1(t-y_1)$ latched by the latch circuit 101, the output data $\mathrm{RVD}^1(t)$ of the register R11 and the coefficient $K_{30}$. then to store the calculated value Y in the register R12, after transferring the output data $\mathrm{RVD}^1$ from the register R11 to the latch cirucit 401, the control signal output register 303 outputs a selection control signal SL1=SELECT(B), a calculation control signal SL1=SELECT(B), a calculation control signal CTL=(Y)=(A)·(X)+(B), and a coefficient read address information ADR(Kn)=ADR($K_{30}$). As a consequence, the coefficient $K_{30}$ is applied to the input A of the calculation circuit 402 in the same manner as the step (c)-(6) described above, and the data $\mathrm{RVD}^1(t-y_1)$ is supplied to the input X of the calculation circuit 402, with the result that the calculation circuit calculates an equation $$\begin{aligned}(Y) &= (A)\cdot(X)+(B)\\ &= K_{30}\cdot RVD^1(t-y_1)+RVD^1(t)\end{aligned}$$

and this calculated value (Y) is stored in the register R12 at the next step.

(3) Then, for the purpose of multiplying the content $[K_{30}\cdot RVD^1(t-y_1)+RVD^1(t)]$ of the register R12 with a coefficient $K_{29}$, the content of the register R12 is transferred to the latch circuit 404 and the control signal output register 303 outputs a selection control signal SL1=SELECT(C), a calculation control signal CTL=Y=(A) (X) and a coefficient read address information ADR(Kn)=ADR($K_{29}$).

Accordingly, the coefficient $K_{30}$ is applied to the input A of the calculation circuit 402, while the data $[K_{30}\cdot RVD^1(t-y_1)+RVD^1(t)]$ is being supplied to the input X of the calculation circuit 402, with the result that the calculation circuit 402 calculates an equation $$\begin{aligned}(Y) &= (A)\cdot(X)\\ &= K_{29}\cdot[K_{30}\cdot RVD^1(t-y_1)+RVD^1(t)]\end{aligned}$$

This calculated value Y is stored in the register R13 at the next step.

(4) Then, for the purpose of adding the content of the register R13 to the data $\mathrm{RVD}^1(t-y_1)$, $y_1$ time before, and storing again the sum in the register R13, in the same manner as the step (d)-(1), the data $\mathrm{RVD}^1(t-y_1)$, $y_1$ time before is read out from the memory section MD0 and latched by the latch circuit 101. After transferring the content $K_{29}\cdot[K_{30}\cdot RVD^1(t-y_1)+RVD^1(t)]$ of the register R13 to the latch circuit 404, the control signal output register 303 produces a selection control signal SL1=SELECT(B) and a calculation control signal CTL, whereby the calculating circuit 402 produces a calculated value Y shown by $$\begin{aligned}(Y) &= (B)+(X)\\ &= RVD^1(t-y_1)+K_{29}\cdot[K_{30}\cdot RVD^1(t-y_1)+RVD^1(t)]\end{aligned}$$

This calculated value Y is stored in the resistor R13 and then outputted as a reverberation tone information $RVD^{2A}$ at the next step.

(5) Then the content of the register R12 is written into an address of the memory section MD0 corresponding to the present time t for the purpose of utilizing the content $[K_{30}\ RVD^1(t-y_1)+RVD^1(t)]$ of the register R12 at a sampling time $(t+y_1)$ later by a time $y_1$.

(6) Thereafter a reverberation tones $RVD^{2B}$ and $RVD^{2C}$ having shorter intervals than (t) are formed in the same manner.

Figure 19:
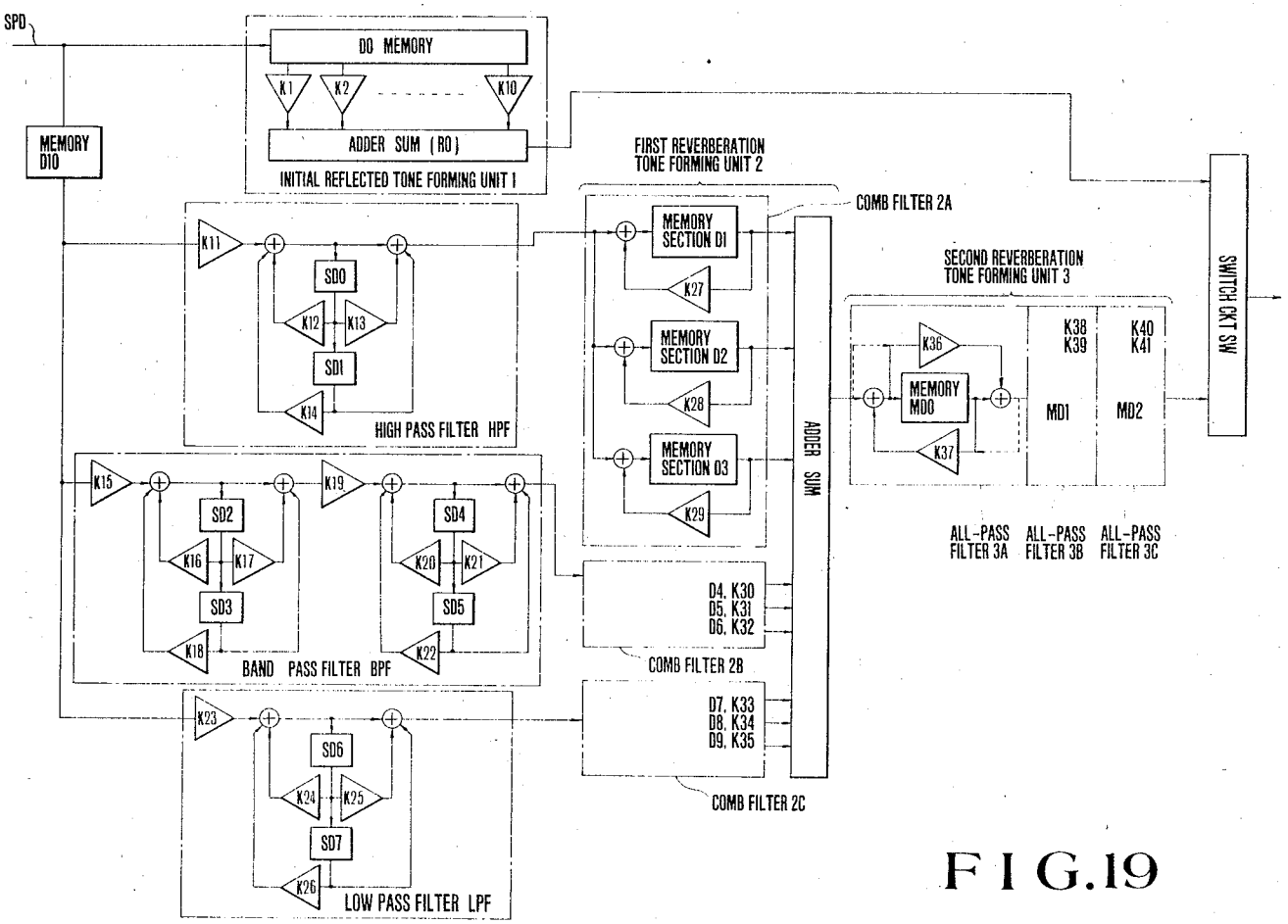
FIG. 19 is a functional block diagram showing another example of the reverberation tone generating apparatus shown in FIG. 7.

Although in the embodiment shown in FIGS. 7 and 8, a bandpass filter 16 provided, it may be omitted in a certain case. Furthermore, as shown in the performance block diagram shown in FIG. 19, the data may be divided into 3 frequency bands by using a high pass filter HPF, a bandpass filter BPF and a low pass filter LPF for forming different reverberation tones for respective frequency bands in the first reverberation tone forming unit 2. This can readily be realized by changing the content of a control program.

It should be understood that the invention is not limitted to the specific embodiment described above and that various changes and modifications may be made without departing from the true siprit and scope of the invention as defined in the appended claims.

In the foregoing embodiment, since the parameters and filter constructions utilized to form a reverberation tone to be added to a musical tone are changed under the control of a control program in relation to the color selecting operation of the tone color selection circuit TSC, a reverberation tone most suitable for the selected tone color can be formed. Moreover, it is possible to change the characteristic of the reverberation tone suitable for the selected tone during performance without performing any troublesome operation. Use of a digital memory device as the delay circuit does not cause degradation of a S/N ratio thus enabling to add a high quality reverberation tone. Moreover, as a reverberation tone whose delay time and level are irregular and a reverberation tone whose delay time and level are regular are formed by independent circuit systems, there is an advantage that reverberation tones having complicated characteristics can be formed with a small and compact circuit.

Where the apparatus shown in FIG. 7 selects another tone color, a reverberation (see Table II) suitable for the selected tone is formed according to various parameters (including the control program) corresponding to the selected tone. For example, as shown in the functional block diagram shown in FIG. 19 different reverberation tones for different frequency bands can be formed where the output data of the memory section D10 are divided into three frequency bands with highpass filter HPF, bandpass filter BPF and lowpass filter LPF.

To mix together a plurality of reverberation tones for different tone colors, a plurality of reverberation tone generating apparatus for different tone colors may be provided. Alternatively, a single reverberation tone generating apparatus may be used on the time division basis for different tone colors so as to form reverberation tones for respective tones and then mixed together the reverberation tones. Like the musical tones produced by a keyboard, the reverberation tones may be added to a rhythm tone. In this case, the addition the reverberations and their characteristics according to the type of the rhythm tones (bongo, claves, etc.) may be controlled automatically in accordance with the selection of the rhythm tone.

The reverberation tones apparatus is not limited to that shown in FIG. 7 utilizing a digital memory device but may be any other construction provided that the reverberation characteristics can be set by parameters applied from outside.

As can be noted from the foregoing description, according to this invention it is possible to add a reverberation tone having a high quality and characteristics most suitable for a selected tone color of a performed musical tone with a simple circuit construction so that the operability and the musical effect of the performance musical tone can be improved.

In the following, a modified embodiment will be described in which, in an electronic musical instrument having a plurality of keyboards, to which reverberations are to be added are selected freely in accordance with the selected tone colors and performance conditions.

Figure 20:
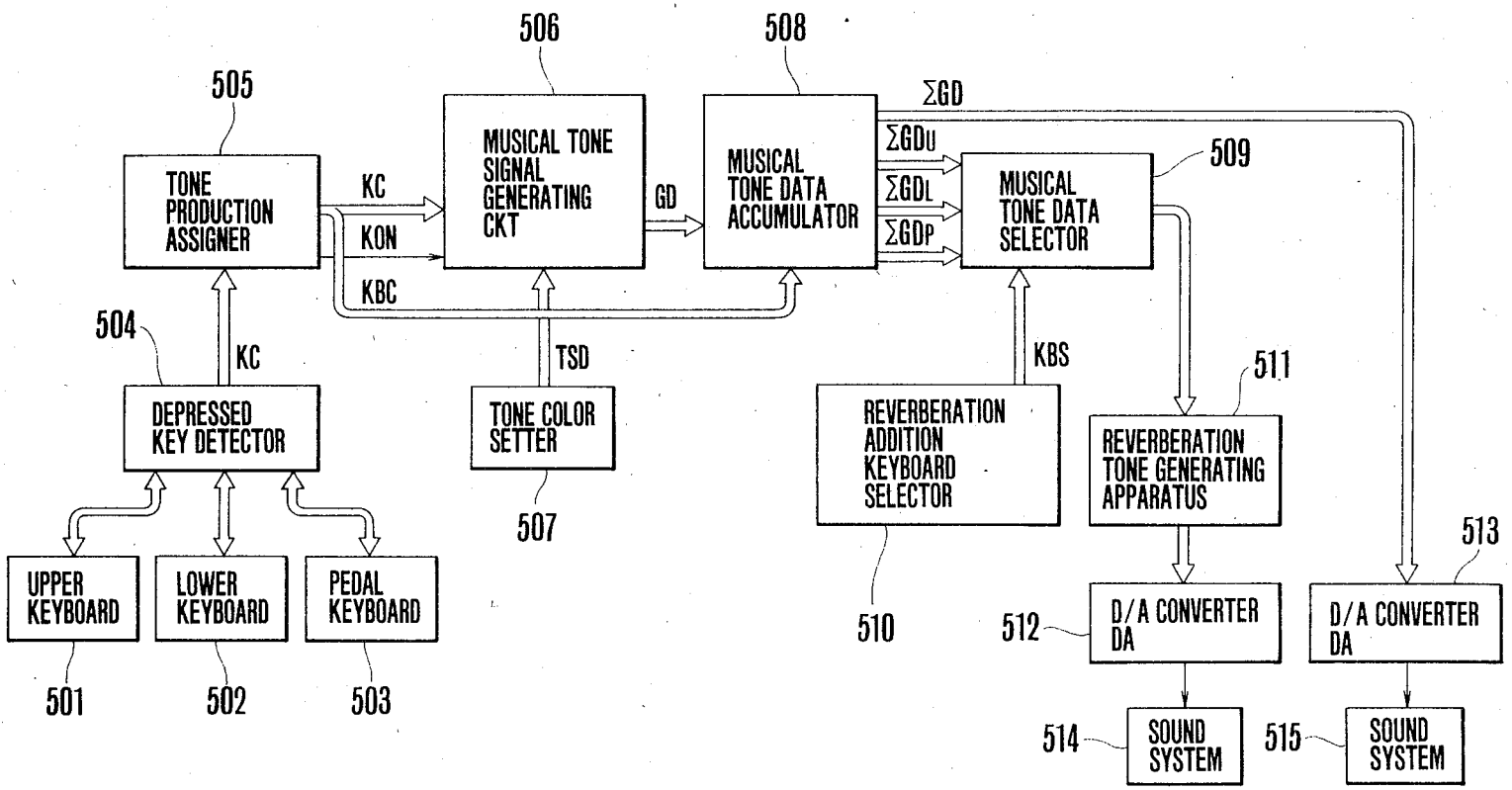
FIG. 20 is a block diagram showing another embodiment of this invention in which reverberation tones are selectively added to musical tone signals produced by a plurality of keyboards.

As shown in FIG. 20, the principal component elements of this modification are a upper keyboard 501, a lower keyboard 502, a pedal keyboard 503, a depressed key detector 504, a tone production assigner 505, a tone signal generator 506, a tone color setter 507, a musical tone data accumulator 508, a musical tone data selector 509, a reverberation addition keyboard selector 510, reverberation tone generating apparatus 511, digital-/analog converters 512 and 513 and sound systems 514 and 515.

Each one of the keyboards 501, 502 and 503 comprises a plurality of keys and a plurality of key switches operated by depressed keys associated therewith, and operated key switches are detected by the depressed key detector 504 which forms key codes KC corresponding to the depressed keys. Each key code KC is constituted by a keyboard code KBC representing the type of the keyboard, an octave code OC representing the note range of the key, and a note code NC representing the note name of the depressed key. The key code KC is supplied to the tone production assigner 505.

The tone production assigner 505 assignes a production of a musical tone corresponding to a depressed key shown by the key code KC supplied from the depressed key detector 504 to either one of a plurality of time divisioned tone production channels contained in the musical tone signal generating circuit 506 so as to output, on the time division basis, the key code KC of the depressed key at a channel timing corresponding to a tone production channel assigned on the time division basis. In this example, the number of the time divisioned tone production channels is 12. The tone production assigner 505 produces a key-on signal that controls the production of a musical tone assigned to a given tone production channel in synchronism with the time divisioned output timing of the key code KC, and the key-on signal KON is applied to the musical tone signal generating circuit 506.

As above described, the musical tone signal generating circuit 506 has 12 time divisioned tone production channels, for example, and when it is supplied with the key code KC of the depressed key from the tone production assigner 505 in synchronism with a channel timing, the musical tone signal generating circuit 506 produces, on the time division basis, a musical tone data (a digital musical tone signal for each tone production channel) of a tone color corresponding to a tone color information TSD set by the key code KC and a tone color setter 507 and having a tone pitch corresponding to the key code KC (octave code OC and the note code NC), the musical tone data GD being outputted on the time division basis. The musical tone signal generating circuit 506 produces a musical tone data GD by using a musical tone signal forming system of the waveform memory read out type, harmonic synthesizing type, frequency modulation type or amplitude modulation type. The musical tone data GD produced by each musical tone channel is imparted with an amplitude envelope ranging from an attack to a decay, in accordance with the key-on signal KON of the musical tone channel. The tone color setter 507 is constructed to set the tone color of each of the upper keyboard 501, the lower keyboard 2 and the pedal keyboard 503, so as to produce a tone color information corresponding to each keyboard. Each tone production channel of the musical tone signal generating circuit 506 forms a musical tone data GD having a tone color corresponding to a tone color information TSD regarding a keyboard represented by the keyboard code KBC of the channel, whereby musical data GD having tone colors different GD having tone colors different for respective keyboards.

As above described the musical tone signal generating circuit 506 forms, on the time division basis, musical tone data GD regarding the depressed keys assigned to respective tone production channels, and supplies the musical tone data thus formed to the musical tone data accumulator 508.

The musical tone data accumulator 508 synthesizes the musical tone data GD for all channels formed by respective tone production channels of the musical tone signal generating circuit 506 to produce a synthesized musical tone data ΣGD of the musical tones corresponding to the depressed keys of all keyboards. Furthermore, the musical tone data accumulator 508 synthesizes the musical tone data regarding the depressed keys of each keyboard to output musical tone data $\Sigma GD_u$, $\Sigma GD_L$ and $\Sigma GD_P$ for respective keyboards. At this time, the assignment of the musical tone data GD formed by respective channels is made according to a keyboard code KBC supplied from the tone production assigner 505. $\Sigma GD_U$, $\Sigma GD_L$ and $\Sigma GD_P$ respectively represent the upper keyboard musical tone data, the lower keyboard musical tone data and the pedal keyboard musical tone data.

The synthesied musical tone data ΣGD synthesized by the musical tone data accumulator 508 and regarding the depressed keys of all keyboards are converted into analog musical tone signals by the digital analog converter 513 and then produced by sound systems 515 as musical tones.

The musical tone data $\Sigma GD_U$, $\Sigma GD_L$ and $\Sigma GD_P$ for respective keyboards are supplied to the musical tone data selector 509 where they are selected by a keyboard selection information KBS supplied from the reverberation adding keyboard selector 510 and the selected data are supplied to the digital type reverberation tone generating apparatus 511.

Then the reverberation trone generating apparatus 511 adds reverberations of desired characteristics to the musical tone data $\Sigma GD_U$, $\Sigma GD_L$ and $\Sigma GD_P$ selected by the musical tone selector 509, and then supplies them to the digital/analog converter 512. Thus the musical tone data (either one of $\Sigma GD_U$, $\Sigma GD_L$ and $\Sigma GD_P$) added with the reverberation tone is converted into an analog signal by the digital/analog converter 512 and then produced by the sound system 514 as a musical tone added with the desired reveberation tone.

Figure 21:
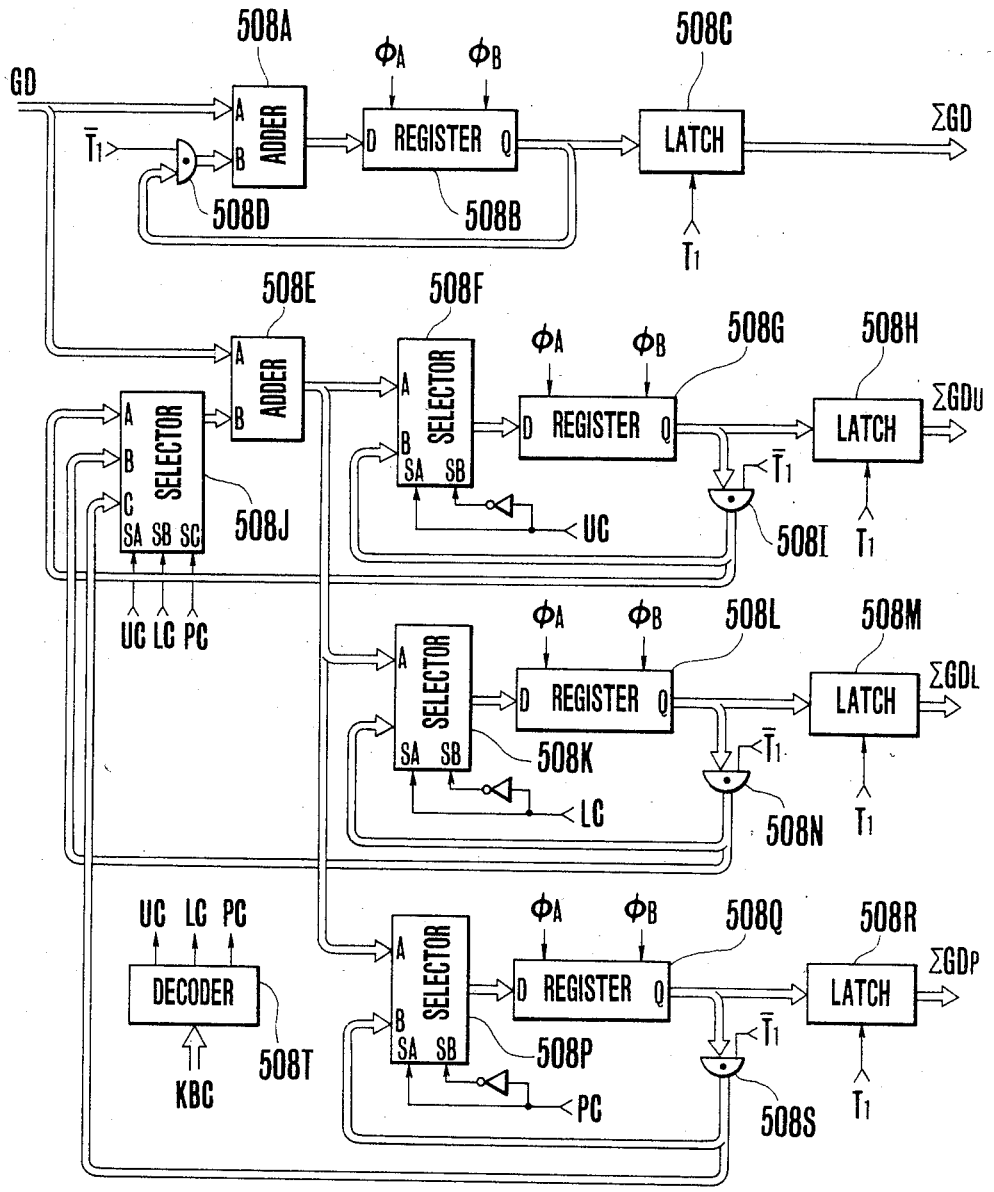
FIGS. 21 and 23 are block diagrams showing two examples of the musical tone data accumulator shown in FIG. 20.

FIG. 21 shows the construction of one example of the musical tone data accumulator 508 in which the synthesized musical tone data ΣGD is formed by a circuit including an adder 508A, a register 508B (delay flip-flop circuit), a latch circuit 508C and an AND gate circuit 508D.

Figure 22:
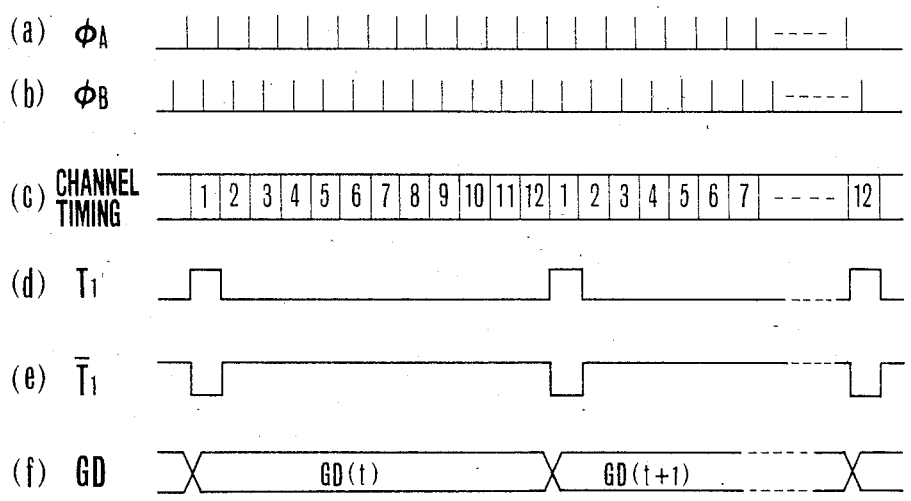
FIG. 22 is a timing chart useful to explain the operation of the musical tone accumulators shown in FIGS. 21 and 23.

More particularly, the musical tone data GD formed in each tone production channel is supplied to an input A of the adder 508A which sequentially adds together the musical tone data GD formed in the first through 12th tone production channels, in cooperation with the register 508B. The output of the register 508B is supplied to the input B of the adder 508A through the AND gate circuit 508D only when a timing signal $T_1$ is "1". As shown by the timing chart shown in FIG. 22, the timing signal $T_1$ (FIG. 22(*e*)) is produced by inverting a timing signal $T_1$ (FIG. 22(*d*)) which becomes "1" at a channel timing correspondig to the first tone production channel among 12 channel timings defined by a clock pulse $\phi_A$. This timing signal $T_1$ is supplied to one input of the AND gate circuit 508D as a gate control signal. Consequently, the outputs of the register 508B are successively applied to the input B of the adder 508A at the channel timings except the channel timing corresponding to the first tone production channel. Consequently, the adder 508A outputs the musical tone data GD of the first tone production channel as it is and supplies the outputted musical tone data GD to the register 508B. Then the register 508B stores the musical tone data GD of the first tone production channel at a time of producing the clock pulse $\phi_A$ shown in FIG. 22 and outputs the stored data at the time of producing a clock pulse $\phi_B$ shown in FIG. 22(*b*). In other words, the register 508B outputs the inputted data after delaying it by an interval corresponding to one channel timing. When the timing signal $T_1$ becomes "1" at a channel timing corresponding to the second tone production channel, the AND gate circuit 508D is enabled so that the musical tone data GD of the first tone production channel stored in the register 508B is applied to the input B of the adder 508A via the AND gate circuit 508D. At ths time, since the musical tone data GD of the second tone production channel is applied to the input A of the adder 508A, this adder outputs the sum of the musical tone data of the first and second tone production channels, and the sum is stored in the register 508B. This operation is repeated until a channel timing corresponding to the 12th tone production channel, is reached, so that when the 12th channel timing is over, the total sum ΣGD of the musical tone data of the 12 tone production channels can be obtained. This total sum ΣGD is latched by the latch circuit 508C at the time of building up of the timing signal $T_1$, held in the latch circuit 508C until the channel timings complete one cycle (until the signal $T_1$ builds up next time) and then outputted from the latch circuit 508C as the synthesized musical tone data ΣGD. FIG. 22(*f*) shows the synthesized musical tone data ΣGD (t) and ΣGD(t+1) at times t and t+1.

Musical tone data $\Sigma GD_U$, $\Sigma GD_L$ and $\Sigma GD_p$ for respective keyboards are formed by similar circuits. However, since an adder 508E for adding a new musical tone data to already accumulated musical tone data is used in common for a plurality of accumulating circuits for respective keyboards, a selector 508J is provided for the input B of an adder 508E and selectors 508F, 508K and 508P are provided for the respective inputs of registers 508G, 508L and 508Q respectively holding the sums of the musical tone data of respective keyboards.

A circuit constituted by an adder 508E, selectors 508J and 508J, a register 508G, a latch circuit 508H and an AND gate circuit 508I acts as an accumulation circuit for forming the upper keyboard musical tone data $\Sigma GD_U$, while a circuit constituted by an adder 508E, selectors 508J and 508K, a register 508L, a latch circuit 508M and an AND gate circuit 508N acts as an accumulation circuit for forming the lower keyboard musical tone data $\Sigma GD_L$. Also a circuit constituted by an adder 508E, selectors 508J and 508P, a register 508Q, a latch circuit 508R and an AND gate circuit 508S acts as an accumulation circuit for forming the pedal keyboard musical tone data $\Sigma GD_P$.

The inputted musical tone data GD of the first tone production channel is applied to the input A of the adder 508F. At this time, since the AND gate circuits 508I, 508N and 508S of respective accumulation circuits are disenabled by the timing signal $T_1$, three inputs A, B and C of the selector 508J are all "0" so that a signal "0" is applied to the input B of the adder 508E. Accordingly, the adder 508E outputs the musical tone data GD inputted to its input A as it is and supplies the data GD to the inputs of the selectors 508E, 508K and 508P of respective accumulation circuits. Selectors 508F, 508K and 508P selectively extracts the musical tone data GD outputted from adder 508E for respective keyboards. More particularly, where the upper keyboard signal UC corresponding to the upper keyboard 501 and obtained by decoding a keyboard code KBC with a decoder 508J is "1", the selector 508F selects the musical tone data GD and supplies it to a register 508G by judging that the musical data GD applied to its input A from the adder 508E relates to a depressed key of the upper keyboard 501. Where the lower keyboard signal LC representing the lower keyboard 502 and formed by decoding the keyboard code KBC with the decoder 508T is "1", the selector 508K selects the musical tone data GD and supplies it to the register 508L by judging that the musical tone data GD inputted to the input A from the adder 508E concerns the depressed key of the lower keyboard 502. Where the pedal keyboard signal PC showing the pedal keyboard 503 and formed by decoding the keyboard code KBC with the decoder 508T is "1", the selector 508P selects the musical tone data GD and supplies it to the register 508Q by judging that the musical tone data GD inputted to the input A of the adder 508E concerns the depressed key of the pedal keyboard 503.

Accordingly, the musical tone data GD outputted from the adder 508E is distributed among registers 508G, 508L and 508Q of the accumulation circuits provided for respective keyboards 501, 502 and 503. Where it is judged that the musical tone data GD of the first tone production channel concerns the depressed key of the pedal keyboard 503, the musical tone data GD is supplied to the register 508Q via the selector 508P to be held therein.

When the timing signal $T_1$ becomes "1" at the channel timing corresponding to the second tone production channel, AND gate circuits 508I, 508N and 508S of respective accumulation circuits are enabled with the result that the data held in the registers 508G, 508L and 508Q of respective accumulation circuits are fed back to the inputs B of the selectors 508F, 508K and 508P of respective accumulation circuits, and are applied to the inputs A, B and C of the selector 508J.

When the upper keyboard signal UC is "1" the selector 508J selects the musical tone data regarding the upper keyboard 501 and supplied to the input A via the AND gate circuit 508I, and the selector 508J selects and outputs the musical tone data GD regarding the upper keyboard 501, whereas when the lower keyboard signal LC is "1", the selector 508J selects the musical tone data GD regarding the lower keyboard 502 and supplied to its input B via the AND gate circuit 508N. Further, when the pedal keyboard signal PC is "1", the selector 508J selects and outputs the musical tone data GD regarding the pedal keyboard 503 and supplied to the input C via the AND gate circuit 508S and the selected output is applied to the input B of the adder 508E.

Accordingly, where the musical tone data GD produced by the second tone production channel relates to the depressed key of the upper keyboard 501, the musical tone data GD held in the register 508G is applied to the inmput B of the adder 508E, while the musical tone data GD of the second tone production channel regarding the upper keyboard 501 is applied to the input A. In this example, however, since the first tone production channel relates to the pedal keyboard 503 the register 508BG is still holding the musical tone data GD, so that the adder 508E outputs the musical tone data GD of the second tone production channel relating to the upper keyboard 501 as it is. The outputted musical tone data GD is stored in the register 508G via the selector 508F.

Where the musical tone data GD of the third tone production channel also relates to the upper keyboard 501, since the register 508G is holding the musical tone data GD of the second tone production channel relating to the upper keyboard 501, the adder 508E produces the sum of the two musical tone data GD of the second and third tone production channels, and the sum is supplied to the register 508G via the selector 508F to be held in the register. Holding of the data in the registers 508L and 508Q of the accumulation circuits regarding the lower keyboard 502 and the pedal keyboard 503 is effected by feeding back the outputs of the registers 508L and 508Q to their inputs through AND gate circuits 508N and 508S and the inputs B of the selectors 508K and 508P respectively.

Similar operations are performed for the performed for the musical tone data GD generated by 12 tone production channels so that when the channel timings complete one cycle, registers 508G, 508L and 508Q respectively store the sums $\Sigma GD_U$, $\Sigma GD_L$ and $\Sigma GD_P$ of the musical tone data GD of respective keyboards. These sums thus obtained are supplied to the musical tone selector 509 shown in FIG. 20 via latch circuits 508H, 508M and 508R respectively. The musical tone data selector 509 selects the musical tone data $\Sigma GD_U$, $\Sigma GD_L$ or $\Sigma GD_P$ regarding a given keyboard and the selected musical tone data is supplied to the reverberation adding apparatus 511.

Figure 23:
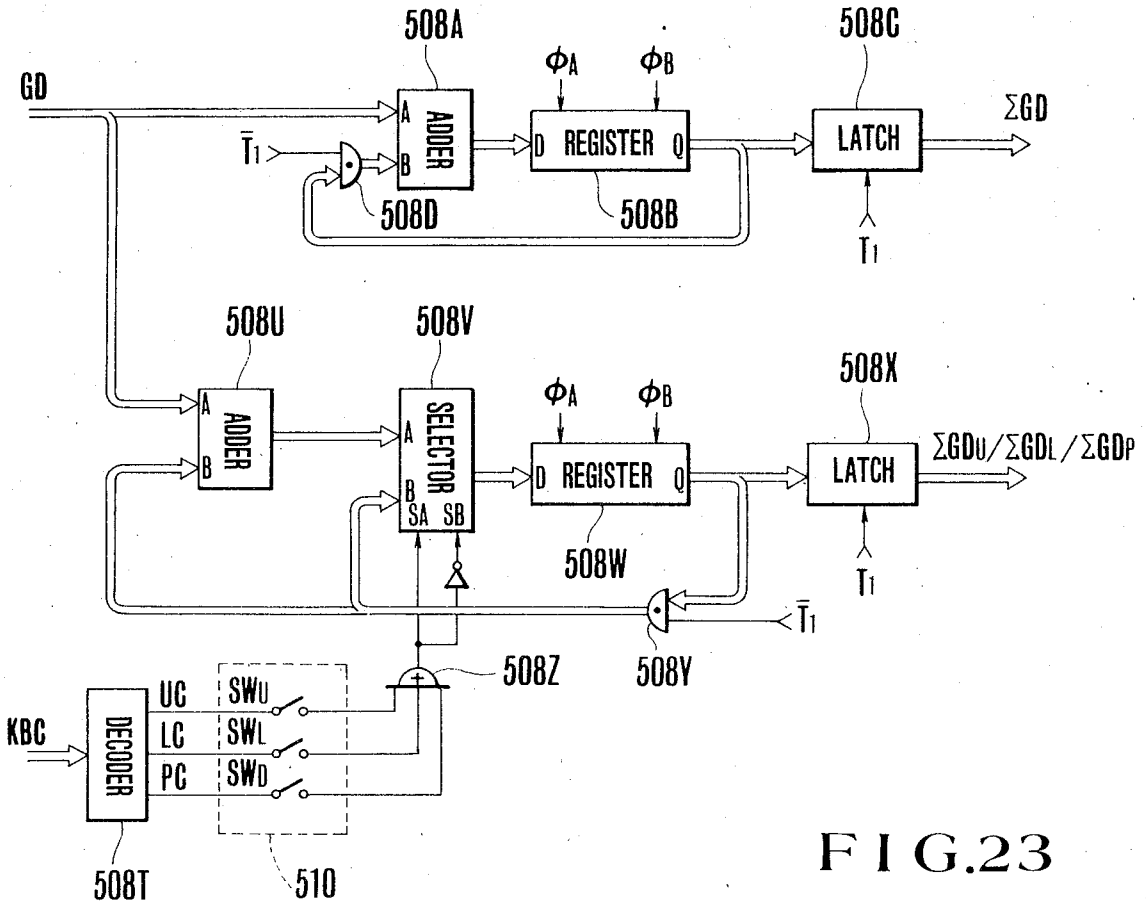

FIG. 23 shows the construction of the musical tone data accumulator 508 where only the musical tone data of a keyboard to be added with a reverberation tone is accumulated. In FIG. 22, the accumulation circuits for forming synthesized musical tone data $\Sigma GD$ of the musical tone data GD regarding the depressed keys of all keyboards 501, 502 and 503 are constructed similar to those shown in FIG. 21. On the otherhand, the accumulation circuit for forming the synthesized musical tone data for each keyboard is provided only one, and only the musical tone data GD designated by the keyboard selection switches $SW_U$, $SW_L$ and $SW_P$ is selected by the selector 508V and accumulated. More particularly, the sum of an adder 508U is applied to the input A of a selector 508V, while the output of a register 508W is fed back to the input B. But to the selection control input SA is selectively applied either one of the upper keyboard signal UC, the lower keyboard signal LC and the pedal keyboard signal PC via an OR gate circuit 508Z depending upon the closure of switch $SW_U$, $SW_L$ or $SW_P$. As a consequence, the selector 508V selects the sum of the adder 508U only at a timing of a tone production channel regarding a keyboard designated by the closure of either one of the switches $SW_U$, $SW_L$ and $SW_P$ and supplies the selected sum to the register 508W, whereby a latch circuit 508X produces a synthesized musical data regarding the depressed keys of one or more keyboards selected by the switches $SW_U$, $SW_L$ and $SW_P$.

The musical tone signal generating circit 506 forms the musical tone data GD of respective tone production channels at a high sampling frequency. However, the residual reverberation tone generating apparatus 511 is not required to form a reverberation tone at the same sampling frequency as that used for forming the musical tone data GD. For example, where the musical tone data GD are formed at a sampling frequency of 50 KHz, the sampling frequency for forming the residual tones may be about 25 KHz.

Figure 24:
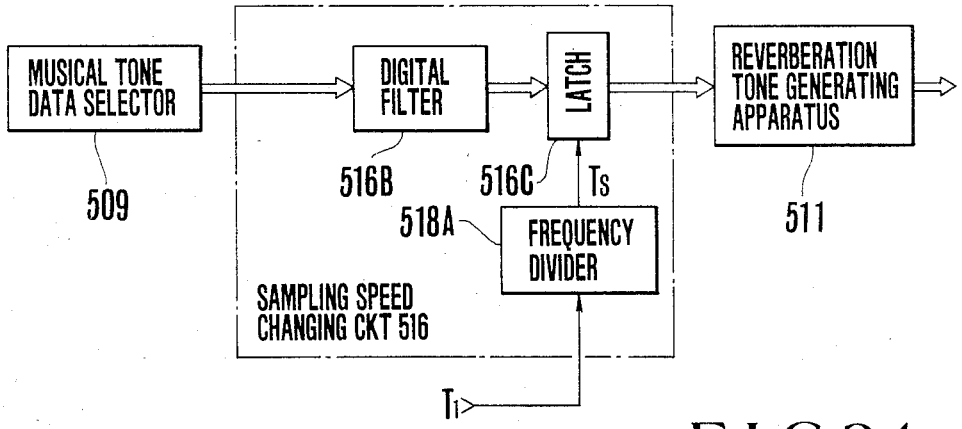
FIG. 24 is a block diagram showing one example of a circuit for changing the sampling speed of the musical tone data supplied to reverberation tone generating apparatus.

As shown in FIG. 24, a sampling speed changing circuit 516 may be provided between the musical tone data selector 509 and the reverberation tone generating apparatus 511 so as to lower the sampling speed for the synthesized musical tone data $\Sigma GD_U$, $\Sigma GD_L$ and $\Sigma GD_P$ for respective keyboards selected by the musical tone data selector 509. More particularly, the frequency of the timing signal $T_1$ of 50 KHz is reduced to $\frac{1}{2}$ with a frequency divider 516A to obtain a sampling pulse $T_s$ of 25 KHz which is used to latch the musical tone data passing through a digital filter 516B by a latch circuit 516C so as to supply the output of the latch circuit 516C to the reverberation tone generating apparatus 511. With this modification it is possible to decrease the memory capacity at the time of forming the reverberation tone with the reverberation tone generating apparatus 511. The digital filter 516B is provided for the purpose of eliminating reflected noise components when changing the sampling speed. However, depending upon the frequency band of the musical tone signal the digital filter 516B may be omitted.

As above described according to this modification in an electronic musical instrument provided with a plurality of keyboards, among the musical tones performed by respective keyboards a musical tone to be added with a reverberation tone is selected so that a reverberation tone most suitable for the set tone colors of respective keyboards can be added. The advantage of using a digital memory device as the reverberation tone generating apparatus is the same as the preceding embodiment.

Figure 25:
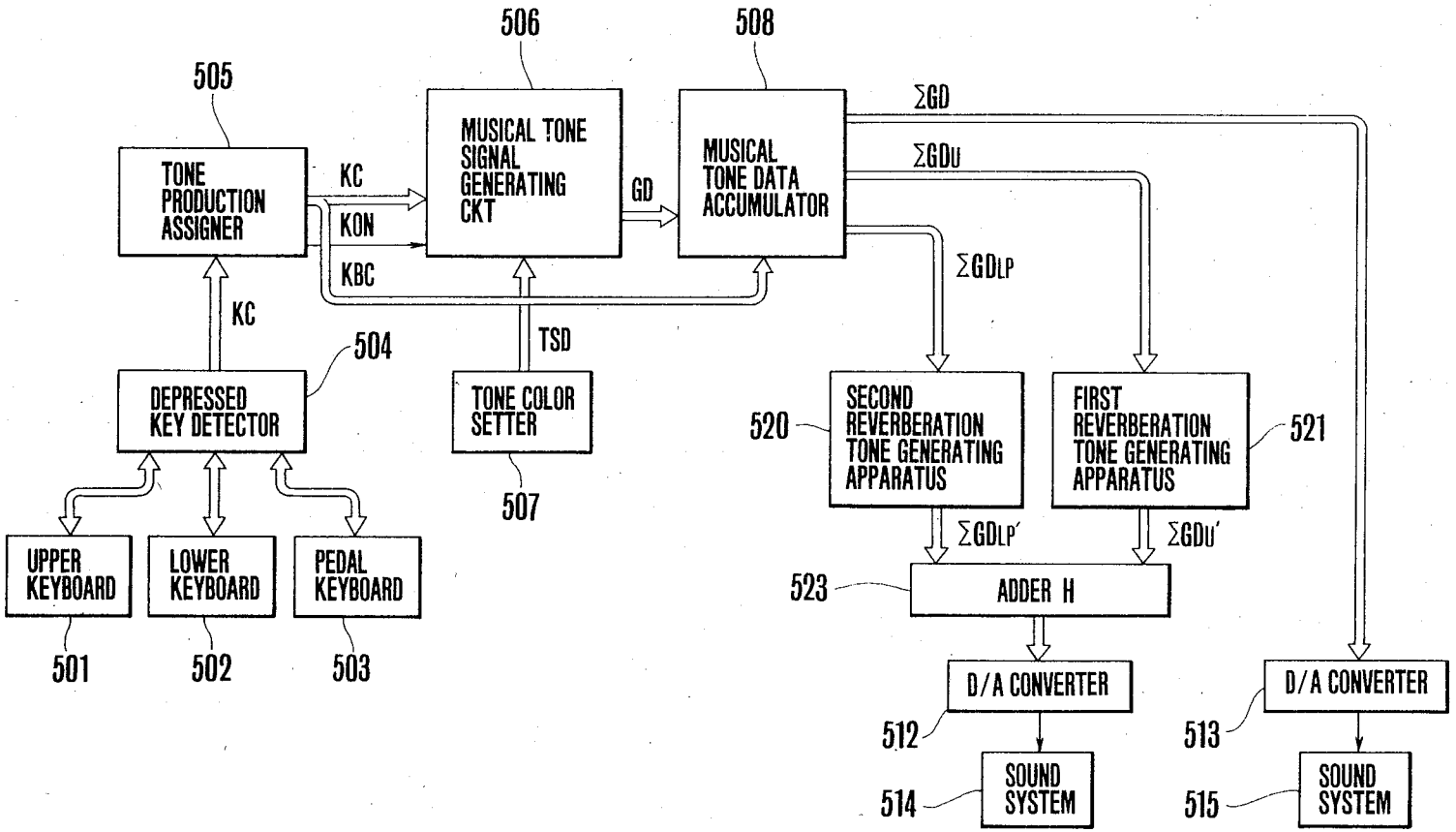
FIG. 25 is a block diagram showing a modification of the circuit shown in FIG. 20.

In still another modification shown in FIG. 25 circuit elements designated by reference charactors 501 through 508, and 512 through 515 are identical to those shown in FIG. 20. In this modification the musical tone data selector 509 the reverberation addition keyboard selector 510 and the reverberation tone generating apparatus 511 shown in FIG. 20 are replaced by first and second reverberation tone generating apparatus 520 and 521 and an adder 523.

More particularly the upper keyboard musical tone data $\Sigma GD_U$ outputted from the musical tone accumulator 508 is applied to the first reverberation tone generating apparatus 521 to be added with a reverberation tone having a desired characteristic. The lower and pedal keyboard musical tone data $\Sigma GD_{LP}$ is supplied to the second reverberation tone generating apparatus 520 to be added with a reverberation tone having a desired reverberation characteristic.

The first and second reverberation adding apparatus 520 and 521 utilize digital memory devices as the delay elements for adding desired reverberation characteristics to the musical tone data $\Sigma GD_U$ and $\Sigma GD_{LP}$ respectively wherein the reverberation characteristics are set to any desired ones according to the delay time information that controls the delay time of the musical tone data and a coefficient that controls the amplitude level.

Accordingly, by setting the delay time informations and the coefficients for controlling the amplitudes to different values for the first and second reverberation tone generating apparatus 521 and 520 different reverberation can be added to the tones of the upper keyboard 501, the lower keyboard 502 and the pedal keyboard 503.

The musical tone data $\Sigma GD_U$ and $\Sigma GD_{LP}$ added with reverberation tones respectively by the first and second reverberation tone generating apparatus 520 and 521 are added together or synthesized by an adder 523 and then supplied to the digital/analog converter 512. The analog musical tone signal thus obtained is then produced as a musical tone added with a reverberation tone by a sound system 514.

Where a reverberation characteristic having a short length and a shallow depth is added to the musical tone produced be the upper keyboard 501, and a reverberation characteristic having a long length and deep depth is added to the musical tones produced by the lower keyboard 502 and the pedal keyboard 503, the melody performance tone produced by the upper keyboard 501 would give stronger impression than the accompaniment tones produced by the other keyboards 502 and 503.

Figure 26:
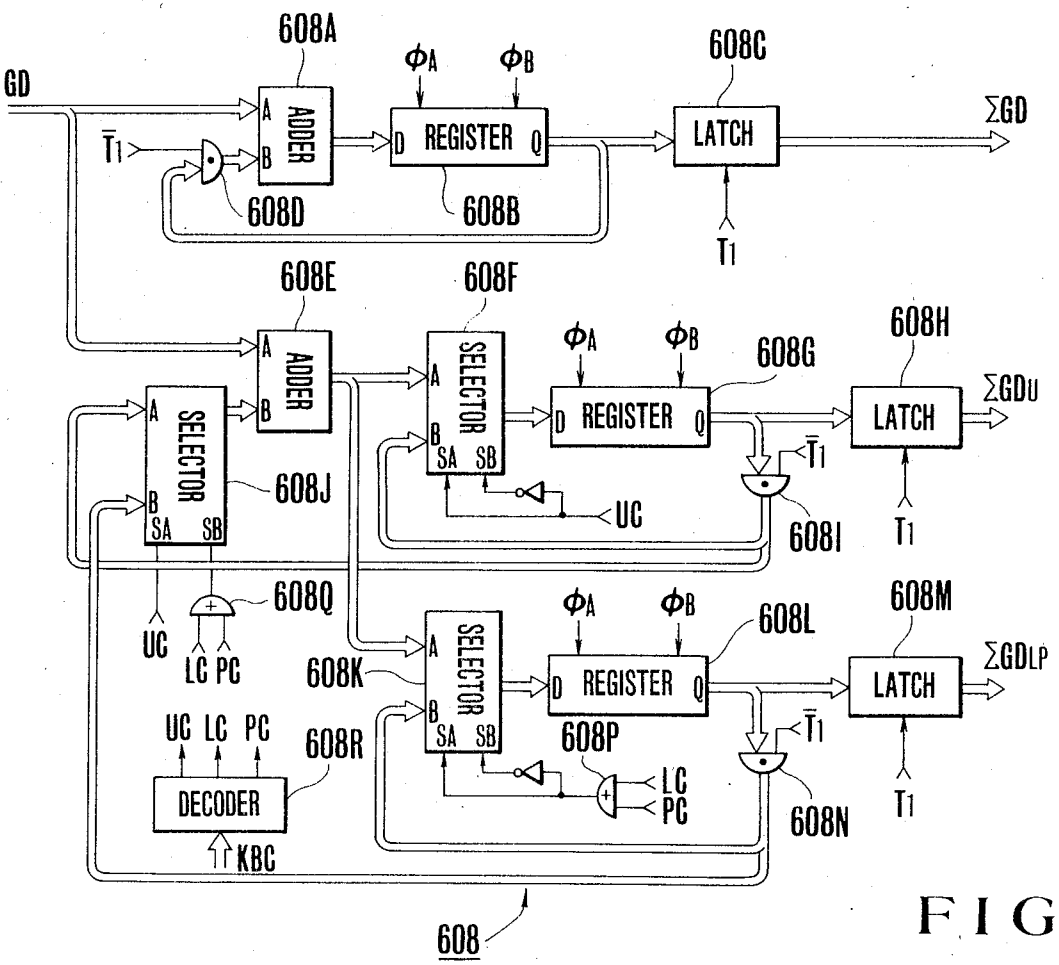
FIG. 26 is a block diagram showing the detail of the musical tone data accumulator shown in FIG. 25.

FIG. 26 shows the construction of the musical tone data accumulator 608 in which the synthesized musical tone data $\Sigma GD$ is formed by a circuit including an adder 608A, a register (delay flip-flop circuit) 608B, a latch circuit 608C and an AND gate circuit 608D.

More particularly, the musical tone data GD formed by respective tone production channels are supplied to the input A of the adder 608A which, in cooperation with register 608B, sequentially accumulates the musical tone data produced by the first through the 12th tone production channels. The output of the register 608B is supplied to the input of the adder 608A via an AND gate circuit 608D only when the timing signal $T_1$ is "1". As shown in FIG. 22, the timing signal 1 is obtained by inverting a timing signal $T_1$ (FIG. 2(*d*)) which becomes "1" at a channel timing corresponding to the first tone production channel among 12 channel timings defined by the clock pulse $\phi_A$. Accordingly, the output of the register 608B is continuously applied to the input B of the adder 608A at the other channel timings except a channel timing corresponding to the first tone production channel. Thus, the adder 608A outputs the musical tone data GD of the first tone production channel as it is. Then the register 608B stores the musical tone data GD of the first tone production channel at the time of producing the clock pulse $\phi_A$ shown in FIG. 2(*a*) and outputs the stored data at the time of producing the clock pulse $\phi_B$ shown in FIG. 22(*b*). In other words, the register 608B outputs inputted data after delaying the same by an interval corresponding to one channel timing. When the timing signal $T_1$ becomes "1" at a channel timing corresponding to the second tone production channel, the AND gate circuit 608D is enabled so that the musical tone data GD held in the register 608B would be applied to the input B of the adder 608A via the AND gate circuit 608D. At this time, since the musical tone data GD of the second tone production channel is applied to the input A of the adder 608A this adder outputs the sum of the musical tone data of the first and second tone production channel, and the sum is held in the register 608B. This operation is repeated up to the channel timing corresponding to the 12th tone production channel, and when the 12th channel timing is over, a total sum ΣGD of the musical tone data GD of the 12 tone production channels can be obtained The total sum ΣGD is latched in a latch circuit 608C at the time of building up of the timing signal $T_1$ and held therein until the channel timings make one cycle (that is the next timing signal $T_1$ builds up) and then outputted from the latch circuit 608C as a synthesized musical tone data ΣGD. The synthesized musical tone data ΣGD(t) and ΣGD(t+1) are shown at times t and t+1 in FIG. 22.

The musical tone data and $\Sigma GD_U$ and $\Sigma GD_{LP}$ for other bkeyboards are formed by similar circuits. However since an adder 608E for adding together a next musical tone data and already accumulated musical tone data is commonly used for the accumulation circuits for different keyboards a selector 608J is provided on the input side of the input B of the adder 608E, and selectors 608F and 608K are provided on the input sides of the registers 608G and 608L respectively holding sums of the musical tone data of different keyboards.

Adder 608E, selectors 608J and 608F, register 608G, latch circuit 608H and AND gate circuit 608I constitute an accumulation circuit which forms the upper keyboard musical tone data $\Sigma GD_U$. In the same manner, adder 608E, selectors 608J and 608K, register 608L, latch circuit 608M and AND gate circuit 608N constitute an accumulation circuit for forming the lower and pedal keyboard musical tone data $\Sigma GD_{LP}$.

After added with the musical tone data GD of the first tone production channel, the musical tone data GD is supplied to the input A of the adder 608E. At this time, since the AND gate circuits 608I and 608N of the accumulation circuits are disabled by the timing signal $T_1$, two inputs A and B of the selector 608J become "0" and the input signal to the input B of the adder 608E also becomes "0". Accordingly, the adder 608E outputs the musical tone data GD of the first tone production channel inputted to its input A as it is and supplies it to the inputs of the selectors 608F and 608K of respective accumulation circuits.

The selectors 608F and 608K select and output the musical tone data GD outputted from adder 608E for different keys. When the upper keyboard signal UC representing the upper keyboard 501 and obtained by decoding the keyboard code KBC with a decoder 608R is "1", the selector 608F selects the musical tone data inputted to the input A from the adder 608E and supplies it to the register 608G by judging that the musical tone data GD relates to the depressed keys of the upper keyboard 501. Where either one of the lower keyboard signal LC representing the lower keyboard 502 and formed by decoding the keyboard code KBC with a decoder 608R and a pedal keyboard signal PC representing the pedal keyboard 503 is "1", a signal "1" is inputted to the control input SA via the OR gate circuit 608P. The selector 608K selects the musical tone data inputted to its input A from the adder 8E and supplies it to the register 608L by judging that the musical tone data GD relates to the depressed keys of the lower keyboard 502 or the pedal keyboard 503.

Accordingly, the musical tone data GD produced by respective tone production channels and outputted from the adder 608E are divided into two, one for the upper keyboard 501, and the other for the lower keyboard 502 and the pedal keyboard 503 according to the keyboard code KBC and distributed between registers 608G and 608L respectively. Suppose now that the musical tone data GD produced by the first tone production channel relates to the depressed keys of the pedal keyboard 503, then the data GD is supplied to the register 608L via the selector 608K and held in the register 608L.

As the timing signal $T_1$ becomes "1" at a channel timing corresponding to the second tone production channel, the AND gate circuits 608I and 608N of respective accumulation circuits are enabled so that the data held in the registers 608G and 608L of respective accumulation circuits are fed back to the inputs B of the selectors 608F and 608K of the same circuit via enabled AND gate circuits 608I and 608N and are also supplied to inputs A and B of the selector 608J.

When the upper keyboard signal UC is "1", the selector 608J selects and outputs the musical tone data supplied to the input A via the AND gate circuit 608I and regarding the upper keyboard 501, whereas when either one of the lower keyboard signal LC and the pedal keyboard signal PC is "1" selects and outputs the musical tone data regarding the lower keyboard 502 and the pedal keyboard 503 and inputted to the input B via the AND gate circuit 608N, since at this time a signal "1" is inputted to the control input B from the OR gate circuit 608Q, and the outputted data is supplied to the input B of the adder 608E.

Where the musical tone data GD produced by the second tone production channel relates to the depressed keys of the upper keyboard 501, the musical tone data GD held in the register 608G is inputted to the input B of the adder 608E, whereas the musical tone data GD produced by the second tone production channel regarding the upper keyboard 501 is applied to the input A of the adder 608E. In this example, however, as above described, since the first tone production channel concerns the pedal keyboard 3, the musical tone data GD is not yet stored in the register 608G so that the adder 608E produces the musical tone data GD of the rsecond tone production channel regarding the upper keyboard 501 as it is, and the outputted musical tone data is supplied and held in the register 608G via the selector 608F.

Where the musical tone data GD of the third tone production channel also relates to the upper keyboard 501, since the register 608G has already been stored the musical tone data GD of the second tone production channel regarding the upper keyboard 501, the adder 608E produces the sum of the musical tone data GD of the second and third tone production channels, and the sum is supplied to the register 608G via the selector 608F and held therein. The holding of the data in the register 608 of the accumulation circuit regarding the lower keyboard 502 and the pedal keyboard 503 is ensured by feeding back the output of the register 608L to its input via AND gate circuit 608N and the input B of the selector 608K.

Similar operations are made for respective musical tone data GD of 12 tone production channels, so that at a time when the channel timings complete one cycle the registers 608G and 608L respectively hold the total sums $\Sigma GD_U$ of the musical tone data GD regarding the upper keyboard 501 and the total sum $\Sigma GD_{LP}$ of the musical tone data GD regarding the lower keyboard 502 and the pedal keyboard 503. The musical tone data $\Sigma GD_U$ and $\Sigma GD_{LP}$ for respective keyboards thus obtained are supplied to the reverberation tone generating apparatus 520 and 520 respectively via latch circuits 608H and 608M.

Figure 27:
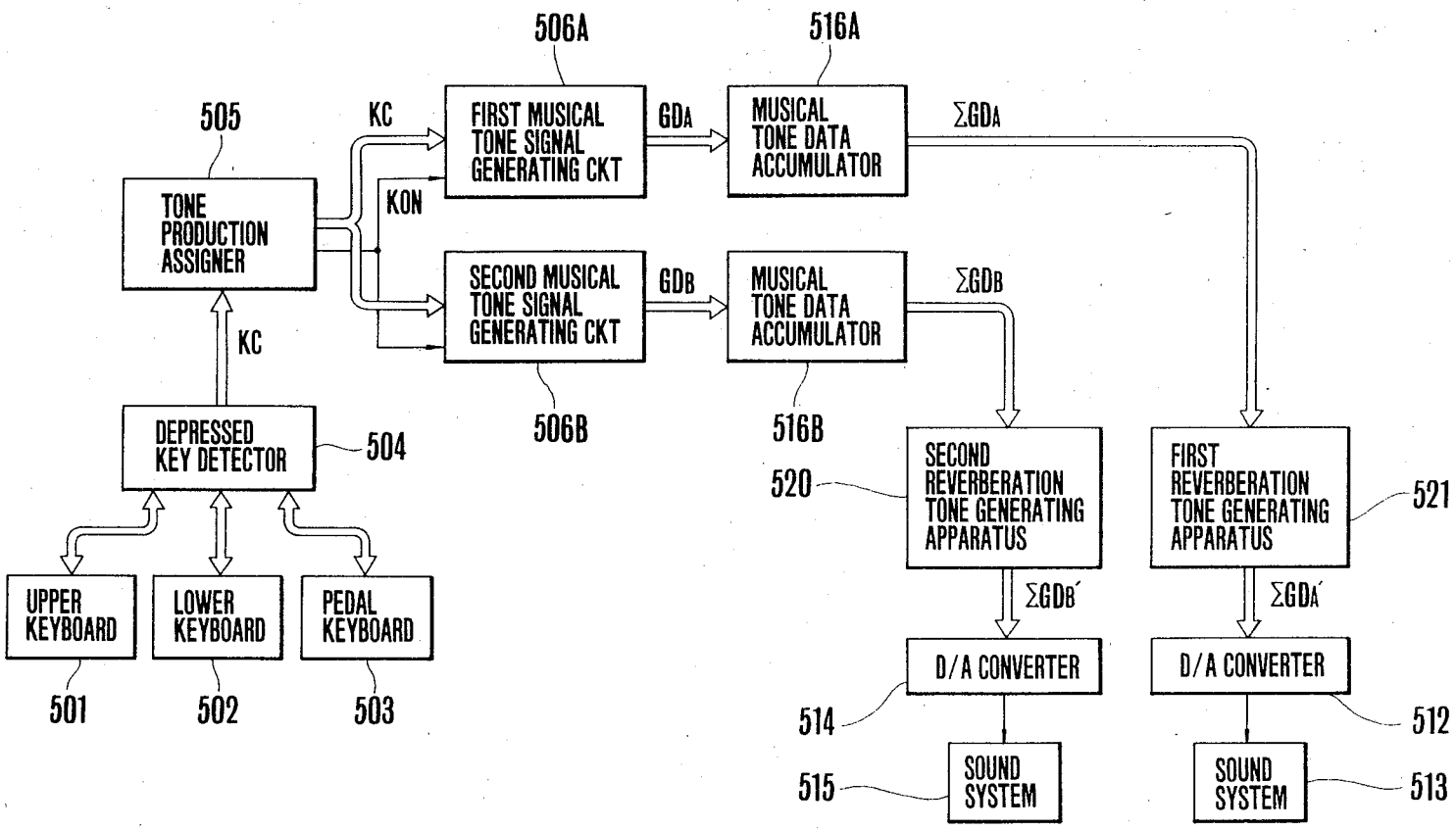
FIG. 27 is a block diagram showing still another modification of this invention.

FIG. 27 shows still another modification of this invention in which reverberation tones having desired reverberation characteristics are added to the signals formed by two musical tone signal generating circuits in which the upper keyboard 501, the lower keyboard 502, the pedal keyboard 503, the depressed key detector 504, the tone production assigner 505, the first and second reverberation tone generating apparatus 509 and 510, D/A converters 512 and 514 and sound systems 513 and 514 are identical to those shown in FIG. 25 but between the tone production assigner 505 and the first and second reverberation tone generating apparatus 509 and 510 are included a first musical tone generating circuit 506A, a first musical tone accumulator 516A, a second musical tone signal generator 506B and a second musical tone data accumulator 516B.

Similar to the musical tone signal generator 506 shown in FIG. 25, each of the first and the second musical tone signal generating circuits 508A and 508B has 12 time divisioned tone production channels so as to form musical tone data GD regarding the depressed keys assigned to respective tone production channels by the tone production assigner 505 and to output on the time division basis, the musical tone data GD thus formed in synchronism with respective channel timings. However, the musical tone data $GD_A$ formed by respective tone production channels of the first musical tone signal generating circuit 506A and the musical tone data $GD_B$ formed by the tone production channels of the second musical tone signal generating circuit 506B have different pitches, tone colors or other musical tone elements. Accordingly, when the tone production of the musical tone regarding the depressed keys are assigned to the first and second musical tone signal generating circuits 506A and 506B, two musical tone data $GD_A$ and $GD_B$ having different musical tone elements for one depressed key are formed simultaneously.

The musical tone data $GD_A$ and $GD_B$ formed by respective tone production channels of the two circuits are supplied to the musical tone accumulators 516A and 516B and synthesized each time when the channel timings complete one cycle and then outputted as the first synthesized musical tone data $\Sigma GD_A$ and the second synthesized musical tone data $\Sigma GD_B$ which are supplied respectively to the first and second reverberation tone generating apparatus 509 and 510 to add reverberation tone having different reverberation characteristics.

Similar to those shown in FIG. 25, the characteristics of the reverberations produced by these reverberation tone generating adding apparatus 509 and 510 can be set to any value by a coefficient that controls the delay time information limiting the delay time of the musical tone and the amplitude level.

The musical tone data $\Sigma GD_{A'}$ and $\Sigma GD_{B'}$ added with reverberation tones of different reverberation characteristics for different circuits are converted into analog musical tone signals by digital/analog converters 512 and 514 repectively and then produced as musical tones added with reverberation tones by sound systems 513 and 514.

Where the first musical tone data $GD_A$ has a low note pitch, for example 16 feet or 32 feet, and the second musical tone data $GD_B$ has a high note pitch, for example 4 feet or 2 feet, and where a reverberation tone having long and deep reverberation characteristics is added to the first musical tone data $GD_A$, and a reverberation tone having short and shallow reverberation characteristics is added to the second musical tone data GD, the second musical tone becomes outstanding, thus providing a performance effect similar to that performed in a concert hall.

the musical tone accumulators 516A and 516B utilized in this embodiment have the same construction as the circuit shown in FIG. 26 adapted to form the synthesized musical tone data $\Sigma GD$.

In this modification too, each of the reverberation tone generating apparatus has the same construction as that shown in FIG. 7.

Figure 28:
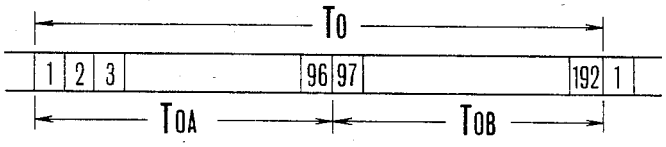
FIG. 28 shows time bands where the reverberation tone generating apparatus is used on the time division basis.
Figure 29A:
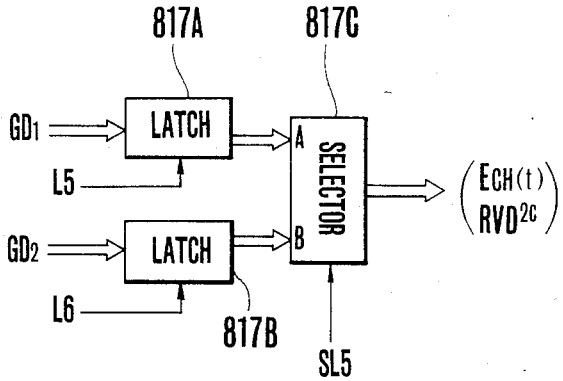
FIG. 29*a* and 29*b* are block diagrams showing input and output circuits respectively of the apparatus.
Figure 29B:
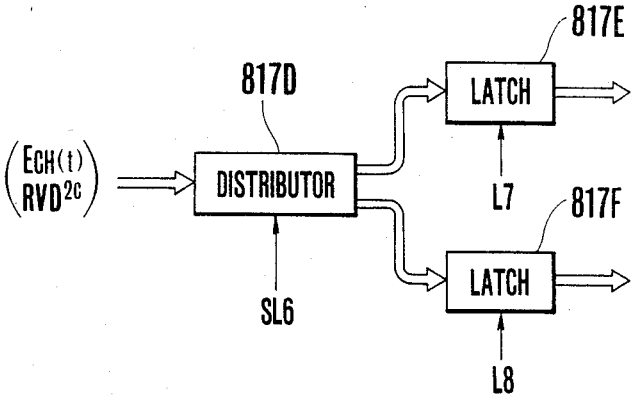

As shown in FIG. 28, one sampling period $T_O$ is divided into two time bands $T_{OA}$ and $T_{OB}$. First to 96th steps of the control program during the time band $T_{OA}$ are used to form the first reverberation tone, while the 97th through 192 steps of the control program during the time band $T_{OB}$ are used to form the second reverberation tone. With this measure, two reverberation tones can be formed on the time division basis with a single reverberation tone generating apparatus, thus simplifying the circuit construction. At this time, the first musical tone data $GD_1$ ($\Sigma GD_U$, $\Sigma GD_A$) and the second musical tone data $GD_2$ ($\Sigma GD_{LP}$, $\Sigma GD_B$) are latched by the latch circuits 817A and 817B provided for the musical tone data $GD_1$ and $GD_2$ according to latch control signals L5 and L6 outputted from the control signal output register 303 (FIG. 7) and one of the musical tone signals thus latched is selected by a selector 817C, on the time division basis, according to the selection control signal SL5 outputted from the control signal output register 303 as shown in FIG. 29*a*. Two reverberation ECH(t) and $RVD^{2C}$ formed on the time division basis are divided into two portions by a selector 817D according to a selection control signal SL6 as shown in FIG. 29*b*, and the divided reverberation data portions are latched by latch circuits 817E and 817F according to latch control signals L7 and L8 and the latched reverberation data portions are outputted as the first and second reverberation data.

Although the musical tone signal generating circuits 506, 506A and 506B form the musical tone signals for respective tone production channels at high sampling frequencies, the reverberation tone generating apparatus 520 and 521 are not required to form reverberation tones at the same sampling frequencies as those used for forming the musical tone data GD, $GD_A$ and $GD_B$. For example, where the musical tone data are formed at a sampling frequency of 50 KHz their reverberation tones can be formed at a lower sampling frequency of the order of about 25 KHz.

Figure 30:
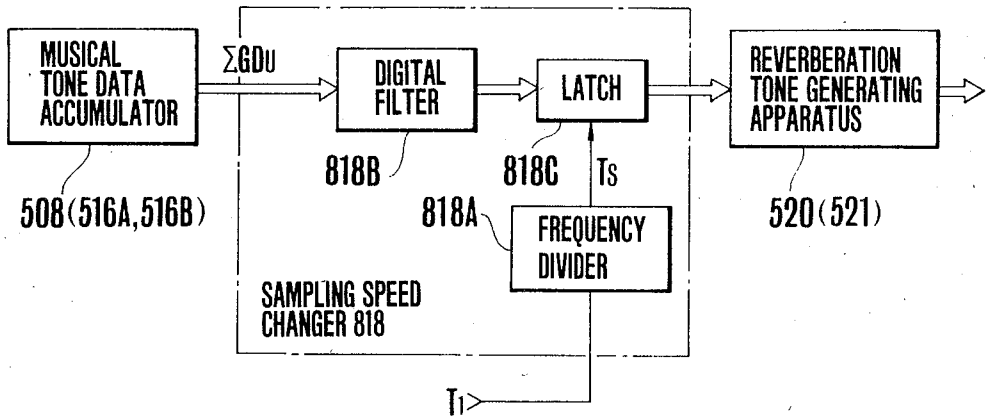
FIG. 30 is a block diagram showing one example of a sampling speed changer.

Thus, as shown in FIG. 30, a sampling speed changer 818 may be provided between the musical tone data accumulator 508 (516A, 516B) and the reverberation tone generating apparatus 520(521) so as to lower the sampling speed of the synthesized musical tone data $\Sigma GD_U(\Sigma GD_{LP}, \Sigma GD_A, \Sigma GD_B)$ formed by the musical tone data accumulator 508 (516A, 516B). More particularly, the frequency 50 KHz of the timing single $T_1$ (FIG. 22(*d*)) is reduced to $\frac{1}{2}$ by a frequency divider 818A to obtain a sampling pulse $T_1$ having a frequency of 25 KHz. This sampling pulse $T_s$ is used to sample and hold in a latch circuit 818C the musical tone data $\Sigma GD_U$ ($\Sigma GD_{LP}$, $\Sigma GD_A$, $\Sigma GD_B$) passing through a digital filter 818B. The data held in the latch circuit 818C is then applied to the reverberation tone generating apparatus 520 (521). This arrangement makes it possible to reduce the capacity of the memory device when a reverberation is formed by the reverberation tone generating apparatus 520 (521). The digital filter 818 is provided for the purpose of eliminating reflected noise component at the time of changing the sampling speed. However the filter is not necessary depending upon the frequency band of the musical tone signal. For the purpose of adding reverberation tones to a plurality of channels having different characteristics, when reverberation forming circuit or parameters for forming the reverberation are prepared for each channel, the circuit becomes complicated and expensive. In such a case, these defects can be obviated by using reverberation forming circuit or parameters in common for respective channels.

As above described according to this embodiment, since a plurality of reverberation tone generating apparatus are provided for a plurality of keyboards or musical tone signal generating devices and since the reverberation characteristics of the reverberation tone generating apparatus can be set freely it is possible to add different reverberation tones to different keyboards or musical tone signal generating devices thus enhancing the performance effect.

What is claimed is:

1. An electronic musical instrument comprising:

a plurality of keyboards, each of which includes a plurality of keys;

musical tone generating means for generating musical tone signals corresponding to said plurality of keyboards respectively;

selecting means for selecting a musical tone signal corresponding to a specified keyboard among said musical tone signals; and reverberation effect imparting means for imparing a reverberation effect to said selected musical tone signal to produce a reverberation tone signal;

said reverberation effect imparting means comprising:

delay length data generating means for generating delay length data; and delayed musical tone generating means for delaying said selected musical tone signal by time length represented by said delay length data to produce said reverberation tone signal.

2. An electronic musical instrument according to claim 1 wherein:

said delayed musical tone generating means comprises a memory device for storing said musical tone signal once and thereafter reading out said musical tone signal;

address information generating means responsive to said delay time information for generating an address information designating a location of said memory device to store said musical tone signal and designating said location to read out said musical tone signal after the lapse of said time length; and readout means for reading out said musical tone signal readout from said location in accordance with said address information, thereby producing said reverberation tone signal.

3. An electronic musical instrument comprising:

a plurality of keyboards, each of which includes a plurality of keys;

musical tone generating means for generating a musical tone signal having a pitch corresponding to a depressed key, said musical tone signal being related to a keyboard to which said depressed key belongs;

reverberation coefficient storing means for storing plural sets of reverberation coefficients corresponding to said plurality of keyboards respectively and;

reverberation effect imparting means which imparts a reverberation effect to said musical tone signal to produce a reverberation tone signal, said reverberation effect being determined by reverberation coefficients corresponding to said keyboards to which said depressed key belongs among said plural sets of reverberation coefficients;

said reverberation coefficient storing means comprising delay length data generating means for generating delay length data as said reverberation coefficients; and reverberation effect imparting means comprising means for delaying said musical tone signal by time length represented by said delay length data to produce said reverberation tone signal.

4. An electronic musical instrument comprising:

keyboard means having a plurality of keys;

tone color selecting means for selecting a tone color among different tone colors and for outputting tone color information representing the selected tone color;

musical tone generating means for generating a musical tone signal having a characteristic determined by a depressed key among said keys and said tone color information; and reverberation effect imparting means for imparting a reverberation effect to said musical tone signal to produce a reverberation tone signal, said reverberation effect being determined by said tone color information;

said reverberation effect imparting means comprising:

delay length data generating means for generating delay length data determined by said tone color information;

delayed musical tone generating means for delaying said musical tone signal by time length represented by said delay length data to produce a delayed musical tone signal;

amplitude data generating means for generating, amplitude data determined by said tone color information; and modifying means for amplitude modifying said delayed musical tone signal in accordance with said amplitude data, thereby outputting said reverberation tone signal.

5. An electronic musical instrument according to claim 4, which further comprises feed back means for feeding back at least a pair of said reverberation tone signals to an input side of said delayed musical tone generating means.

6. An electronic musical instrument comprising:

keyboard means having a plurality of keys;

tone color selecting means for selecting a tone color among different tone colors and for outputting tone color information representing the selected tone color;

tone generating means for generating a musical tone signal having a pitch corresponding to a depressed key among said keys and said selected tone color in response to said tone color information;

coefficient memory means for storing reverberation coefficients corresponding to the tone color selected by said tone color selecting means which determine a reverberation characteristic to be added to said musical tone signal;

program memory means for storing a program which provides the sequence of calculations to impart said musical tone signal with said reverberation characteristic;

calculation means for performing the sequence of calculations specified by said program, said calculation means comprising a digital memory means having a plurality of memory areas for serving as delay elements, and an address information generator means by which the musical tone signal can be written in and read out of said digital memory means in a predetermined period of time to materialize a delay, said delay being dependent on the tone color selected; and control means for reading out said program and said reverberation coefficients, for providing said calculation means therewith, said calculation means performing the calculations of said musical tone signal and said reverberation coefficients on a time division basis in accordance with said program and outputting a reverberation tone corresponding to the tone color selected by said tone color selecting means.

7. An electronic musical instrument according to claim 6 wherein said coefficient memory means comprises a parameter memory device for storing parameters determining different reverberation characteristics corresponding to said different tone colors respectively and for outputting a parameter corresponding to said selected tone color in response to said tone color information, said reverberation characteristic being determined by said parameter.

8. An electronic musical instrument comprising:

a plurality of keyboards;

a musical tone signal generating apparatus for producing digital musical tone signals corresponding to depressed keys of respective keyboards;

coefficient memory means for storing reverberation coefficients corresponding to depressed keys of said respective keyboards which determine reverberation characteristics to be added to said musical tone signals;

program memory means for storing a program which provides the sequence of calculations to impart said musical tone signals with said reverberation characteristics;

calculation means for performing the sequence of calculations specified by said program, said calculation means comprising a digital memory means having a plurality of memory areas for serving as delay elements, and an address information generator means by which the musical tone signal can be written in and read out of said digital memory means in a predetermined period of time to materialize a delay, said delay being dependent on the tone color selected; and control means for reading out said program and said reverberation coefficients, for providing said calculation means therewith, said calculation means performing the calculations of said musical tone signals and said reverberation coefficients on a time division basis in accordance with said program and outputting reverberation tones corresponding to depressed keys of said respective keyboards.

9. An electronic musical instrument according to claim 8 further comprising reverberation keyboard selection means for selecting which ones of said plurality of keyboards are to provide information for determining said reverberation coefficients.

* * * * *

UNITED STATES PATENT AND TRADEMARK OFFICE

CERTIFICATE OF CORRECTION

PATENT NO. : 4,586,417

DATED : May 6, 1986

INVENTOR(S) : Kato et al.

It is certified that error appears in the above-identified patent and that said Letters Patent is hereby corrected as shown below:

| COLUMN | LINE | DESCRIPTION |
|---|---|---|
| 8 | 14 | Delete "$-1 \leq K \leq 0$" and insert -- $-1<K<0$--. |
| 9 | 4 | Delete "$(t - {}_{10})$" and insert --$(t - i_{10})$--. |
| 14 | 64 | Delete "followin" and insert --following--. |
| 15 | 1 & 2 | Delete "$RVd^{2B}=RVD^{2A}(t-y_2)+K_{31}\cdot[RVD^{2A}(t)= k_{32}\cdot RVD_2(t-y_2)]$" and insert --$RVD^{2B}=RVD^{2A}(t-y_2)+K_{31}\cdot[RVD^{2A}(t)+K_{32}\cdot RVD^{2A}(t-y_2)]$--. |
| 15 | 4 & 5 | Delete "$RVD^{2C}=RVD^{2B}(t-y_3)=K_{32}\cdot[RVD^{2B}(t)= K_{34}\cdot RVD^{2B}(t-y_3)]$ and insert --$RVD^{2C}=RVD^{2B}(t-y_3)+K_{32}\cdot[RVD^{2B}(t)+K_{34}\cdot RVD^{2B}(t-y_3)]$--. |

UNITED STATES PATENT AND TRADEMARK OFFICE

CERTIFICATE OF CORRECTION

PATENT NO. : 4,586,417

DATED : May 6, 1986

INVENTOR(S) : Kato et al.

It is certified that error appears in the above-identified patent and that said Letters Patent is hereby corrected as shown below:

| COLUMN | LINE | DESCRIPTION |
|---|---|---|
| 15 | 10 | Delete "$y>y_2>y_3$" and insert --$y_1>y_2>y_3$-- |
| 20 | 35-44 | Please delete the following: |

"(Y)=(A)•(X)+(B) (7-1)
(Y)=(X)+(B) (7-2)
(Y)=(X) (7-3)
(Y)=(B) (7-4)
(Y)=(0) (7-5)" and insert the following:
--(Y)=(A)•(X)+(B) (7-1)
(Y)=(X)+(B) (7-2)
(Y)=(X) (7-3)
(Y)=(B) (7-4)
(Y)=(0) (7-5)--

UNITED STATES PATENT AND TRADEMARK OFFICE

CERTIFICATE OF CORRECTION

PATENT NO. : 4,586,417

DATED : May 6, 1986

INVENTOR(S) : Kato et al.

It is certified that error appears in the above-identified patent and that said Letters Patent is hereby corrected as shown below:

| COLUMN | LINE | DESCRIPTION |
|---|---|---|
| 29 | 48 | Delete "Table II" and insert --Table I--. |
| 32 | 17 | Delete "$T_1$" and insert --$\overline{T_1}$--. |
| 32 | 19 | Delete "$T_1$" and insert --$\overline{T_1}$--. |
| 32 | 23 | Delete "$T_1$" and insert --$\overline{T_1}$--. |
| 32 | 39 | Delete "$T_1$" and insert --$\overline{T_1}$--. |
| 33 | 22 | Delete "$T_1$" and insert --$\overline{T_1}$--. |
| 33 | 62 | Delete "$T_1$" and insert --$\overline{T_1}$--. |
| 36 | 55 | Delete "$T_1$" and insert --$\overline{T_1}$--. |
| 36 | 57 | Delete "$T_1$" and insert --$\overline{T_1}$--. |
| 36 | 68 | Delete "2a" and insert --22a--. |
| 37 | 2 | Delete "22b" and insert --23b--. |

UNITED STATES PATENT AND TRADEMARK OFFICE

CERTIFICATE OF CORRECTION

PATENT NO. : 4,586,417

DATED : May 6, 1986

INVENTOR(S) : Kato et al.

It is certified that error appears in the above-identified patent and that said Letters Patent is hereby corrected as shown below:

| COLUMN | LINE | DESCRIPTION |
|---|---|---|
| 37 | 5 | Delete "$T_1$" and insert --$\overline{T_1}$--. |
| 37 | 51 | Delete "$T_1$" and insert --$\overline{T_1}$--. |
| 38 | 22 | Delete "$T_1$" and insert --$\overline{T_1}$--. |
| 38 | 42 | Delete "608F" and insert --608E--. |

Signed and Sealed this

Twenty-fourth Day of March, 1987

*Attest:*

DONALD J. QUIGG

*Attesting Officer* *Commissioner of Patents and Trademarks*